US011092005B2

(12) United States Patent
DePavia et al.

(10) Patent No.: US 11,092,005 B2
(45) **Date of Patent: *Aug. 17, 2021**

(54) EM-TELEMETRY REMOTE SENSING WIRELESS NETWORK AND METHODS OF USING THE SAME

(71) Applicant: Schlumberger Technology Corporation, Sugar Land, TX (US)

(72) Inventors: Luis Eduardo DePavia, Sugar Land, TX (US); Gaelle Jannin, Houston, TX (US); Jiuping Chen, San Pablo, CA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/519,555

(22) Filed: Jul. 23, 2019

(65) Prior Publication Data

US 2019/0345818 A1 Nov. 14, 2019

Related U.S. Application Data

(63) Continuation of application No. 15/574,509, filed as application No. PCT/US2016/034523 on May 27, 2016, now Pat. No. 10,378,337.

(Continued)

(51) Int. Cl.
*E21B 47/13* (2012.01)
*E21B 47/092* (2012.01)

(Continued)

(52) U.S. Cl.
CPC ..... *E21B 47/13* (2020.05); *E21B 7/04* (2013.01); *E21B 45/00* (2013.01); *E21B 47/024* (2013.01);

(Continued)

(58) Field of Classification Search
CPC ..... E21B 49/08; E21B 47/024; E21B 7/04; E21B 45/00; E21B 49/00; E21B 47/0905; E21B 47/122

(Continued)

(56) References Cited

U.S. PATENT DOCUMENTS 3,079,550 A 2/1963 Huddleston, Jr.
4,739,325 A * 4/1988 MacLeod ..... E21B 17/003 324/342

(Continued)

FOREIGN PATENT DOCUMENTS

WO 2007127182 A2 11/2007
WO 2017083152 A1 5/2017

OTHER PUBLICATIONS

International Search Report and Written Opinion issued in International Patent application PCT/US2016/034523, dated Sep. 20, 2016. 13 pages.

(Continued)

*Primary Examiner* — Emily C Terrell

(57) ABSTRACT

A surface system for an electromagnetic telemetry remote sensing wireless system includes a surface acquisition system configured to receive wireless signals and a plurality of nodes deployed at Earth's surface in a drilling area. Each of the nodes includes a distinct pair of first and second spaced apart electrodes and is configured to digitize voltage differences between the corresponding first and second electrodes and to wirelessly transmit the digitized voltage differences to the surface acquisition system. The voltage differences include an electromagnetic signal transmitted by a downhole tool deployed in a wellbore in the drilling area.

19 Claims, 17 Drawing Sheets

Related U.S. Application Data

(60) Provisional application No. 62/168,430, filed on May 29, 2015.

(51) Int. Cl.

| | |
|---|---|
| ***E21B 7/04*** | (2006.01) |
| ***E21B 45/00*** | (2006.01) |
| ***E21B 47/024*** | (2006.01) |
| ***E21B 49/00*** | (2006.01) |
| ***E21B 49/08*** | (2006.01) |

(52) U.S. Cl.
CPC ..... *E21B 47/092* (2020.05); *E21B 49/00* (2013.01); *E21B 49/08* (2013.01)

(58) Field of Classification Search
USPC ..... 340/854.6
See application file for complete search history.

(56) References Cited

U.S. PATENT DOCUMENTS

| | | | | |
|---|---|---|---|---|
| 4,980,682 | A | 12/1990 | Klein et al. | |
| 5,091,725 | A * | 2/1992 | Gard | E21B 47/13 340/854.1 |
| 6,167,156 | A | 12/2000 | Antoniades et al. | |
| 6,657,597 | B2 | 12/2003 | Rodney et al. | |
| 7,151,466 | B2 | 12/2006 | Gabelmann et al. | |
| 7,243,028 | B2 | 7/2007 | Young et al. | |
| 7,268,696 | B2 | 9/2007 | Rodney et al. | |
| 7,649,474 | B1 * | 1/2010 | Gard | E21B 47/13 340/854.6 |
| 8,242,928 | B2 * | 8/2012 | Prammer | E21B 47/06 340/853.7 |
| 10,113,418 | B2 | 10/2018 | Kusuma et al. | |
| 2003/0025639 | A1 | 2/2003 | Rodney et al. | |
| 2003/0151977 | A1 | 8/2003 | Shah et al. | |
| 2004/0069514 | A1 | 4/2004 | Rodney et al. | |
| 2006/0041795 | A1 | 2/2006 | Gabelmann et al. | |
| 2007/0052551 | A1 | 3/2007 | Lovell et al. | |
| 2007/0201308 | A1 | 8/2007 | Wassermann et al. | |
| 2007/0247330 | A1 * | 10/2007 | Clark | G01V 11/00 340/854.6 |
| 2009/0261986 | A1 * | 10/2009 | Mehta | E21B 47/125 340/853.6 |
| 2010/0259267 | A1 * | 10/2010 | Rosthal | G01V 3/30 324/339 |
| 2011/0168446 | A1 | 7/2011 | Lemenager et al. | |
| 2011/0187553 | A1 | 8/2011 | Rodney | |
| 2015/0337650 | A1 | 11/2015 | Balogh et al. | |
| 2016/0108724 | A1 | 4/2016 | Jarrot | |
| 2017/0241259 | A1 | 8/2017 | White et al. | |
| 2018/0038225 | A1 * | 2/2018 | Wilson | H04B 10/40 |
| 2018/0128097 | A1 | 5/2018 | DePavia et al. | |

OTHER PUBLICATIONS

International Perliminary Report on Patentability issued in International Patent appliction PCT/US2016/034523 dated Dec. 5, 2017, 11 pages.

Evans et al., The Price of Poor Power Quality, American Association of Drilling Engineers. AADE-11-NTCE-7. National Technical Conference and Exhibition, Houston, Texas, Apr. 12-14, 2011. 17 pages.

Marsala et al., First Borehole to Surface Electromagnetic Survey in KSA: Reservoir Mapping and Monitoring at a New Scale, Saudi Aramco Journal of Technology, Winter 2011. pp. 36-78.

Colombo et al., Sensitivity Analysis of 3D Surface-Borehole CSEM for a Saudi Arabian Carbonate Reservoir, SEG Las Vegas 2012 Annual Meeting. 5 pages.

Strack et al., Full Field Array Electromagnetics: Advanced EM from the Surface the Borehole, Exploration to Reservoir Monitoring, 9th Biennial International Conference & Exposition on Petroleum Geophysics, Hyderabad, India. 2012.

Zhdanov et al., Electromagnetic Monitoring of CO2 Sequestration in Deep Reservoirs, First Break, vol. 31, pp. 71-78, Feb. 2013.

* cited by examiner

FIG. 11
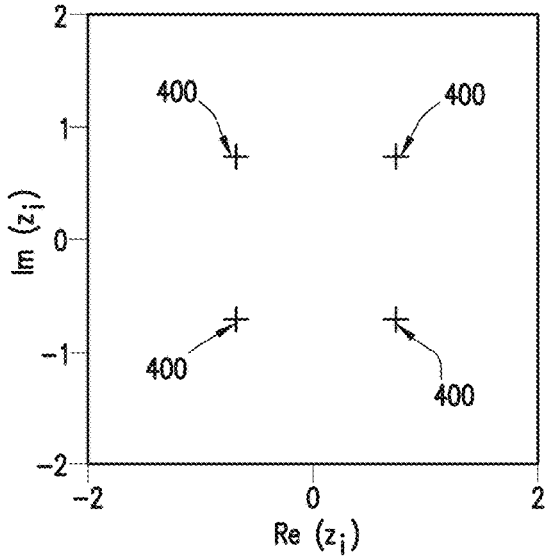
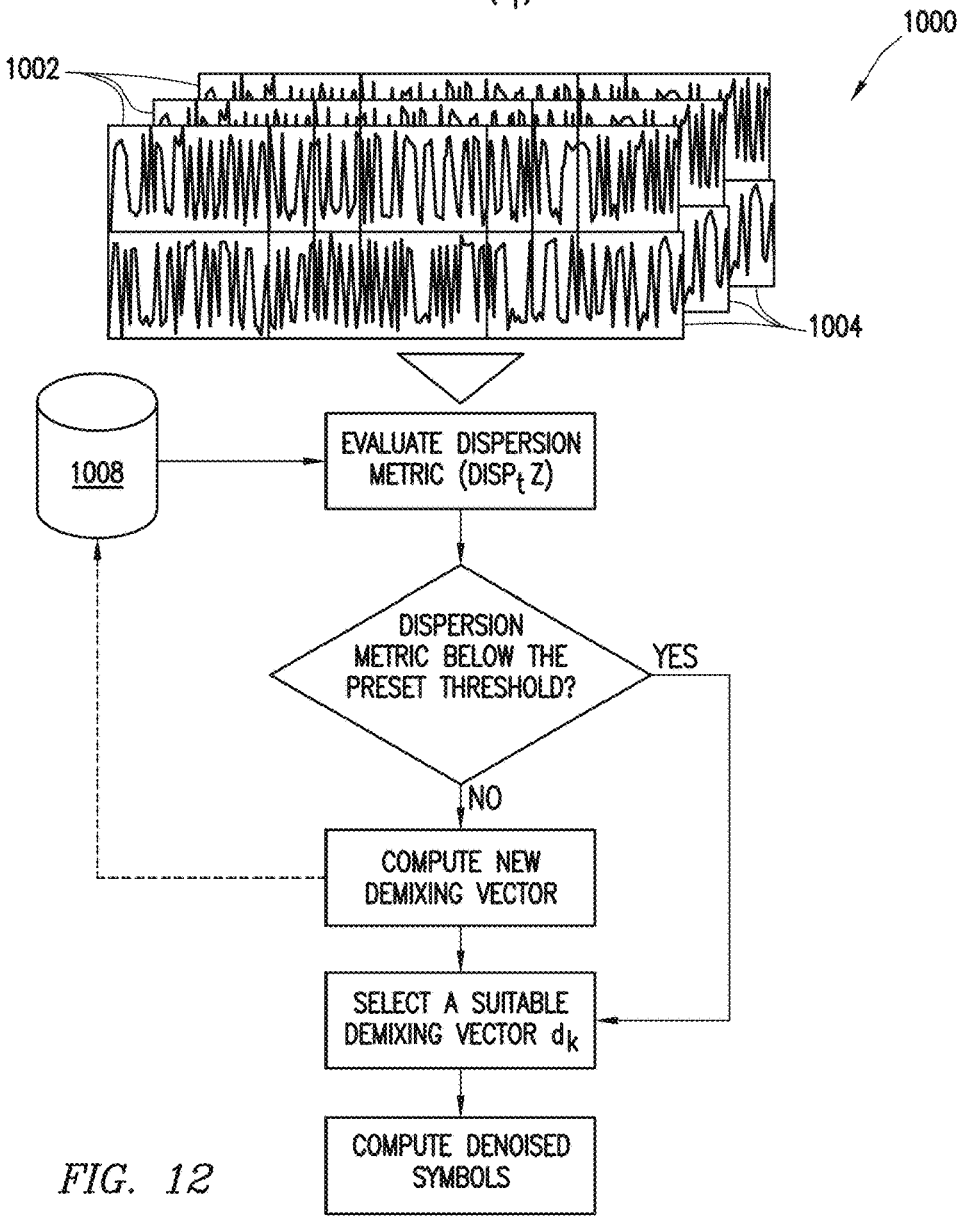
FIG. 12

EM-TELEMETRY REMOTE SENSING WIRELESS NETWORK AND METHODS OF USING THE SAME

CROSS-REFERENCE TO RELATED APPLICATIONS

The present application is a Continuation of U.S. application Ser. No. 15/574,509, filed Nov. 16, 2017, which is a National Stage Entry of PCT/US16/34523, filed May 27, 2016, which claims the benefit of, and priority to, U.S. Provisional Patent Application No. 62/168,430, filed May 29, 2015, each of which are hereby incorporated by reference in their entirety.

BACKGROUND

A current limitation of electromagnetic telemetry remote sensing systems is that signal amplitude received at surface can be small with respect to electrical noise picked up by the stakes or other equipment that serve as electrodes. Hence, under high noise conditions, the signal received is often corrupted, and consequently the demodulation and decoding result in erroneous or missing information.

A second limitation is the fact that the field crew must nail down a set of electrode rods deep in the ground for every rig and several hundred feet of wire must be run from these stakes to a data acquisition system, typically located in a shack near the rig. Worse yet, the setup frequently involves routing wires through roads, local rig vehicle traffic, fences etc. . . . and is time consuming, requiring testing for proper ground connection each time and complicated logistics, provides an increased safety risk exposure and can lead to cable damage and unexpected failures.

A need exists, therefore, for reliable sensing of EM signals in environments where the EM signal may be small and the noise level high, and the burden of hard wiring and complicated installation logistics are omitted.

SUMMARY

An electromagnetic telemetry remote sensing wireless system and methods for using the system are disclosed. A surface system includes a surface acquisition system configured to receive wireless signals and a plurality of nodes deployed at Earth's surface in a drilling area. Each of the nodes includes a distinct pair of first and second spaced apart electrodes and is configured to digitize voltage differences between the corresponding first and second electrodes and to wirelessly transmit the digitized voltage differences to the surface acquisition system. The voltage differences include an electromagnetic signal transmitted by a downhole tool deployed in a wellbore in the drilling area.

BRIEF DESCRIPTION OF THE DRAWINGS

The above and further advantages of this invention may be better understood by referring to the following description in conjunction with the accompanying drawings, in which like numerals indicate like structural elements and/or features in various figures. The drawings are not necessarily to scale, emphasis instead being placed upon illustrating the principles of the invention.

FIG. 11 shows an example of what might be expected in a Quadrature Phase-Shift Keying ("QPSK") modulation.

FIG. 12 illustrates an example method associated with the array noise reduction manager.

DETAILED DESCRIPTION

Figure 1:
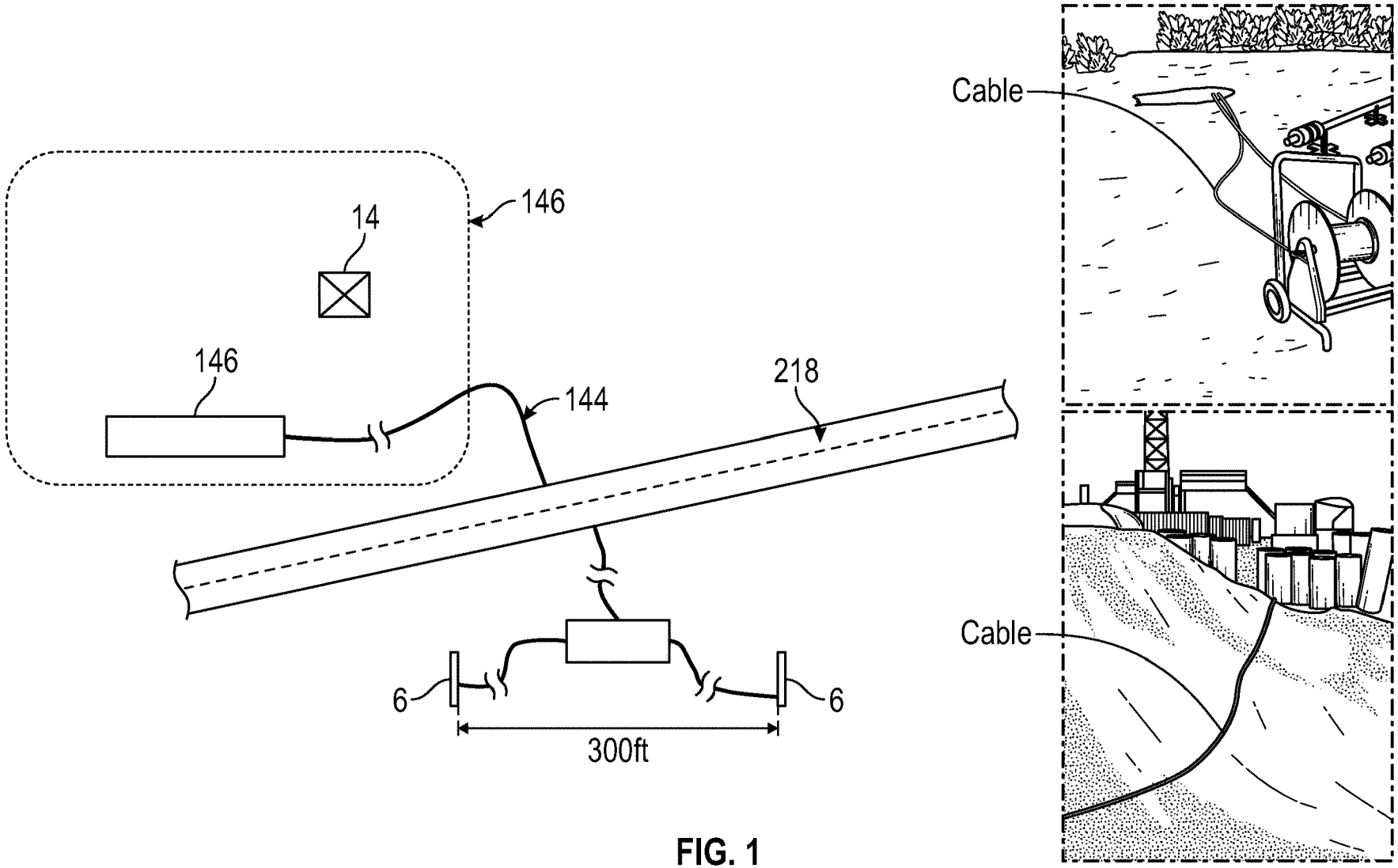
FIG. 1 illustrates how the cable and the stakes can be placed around a rig infrastructure during job setup where stake placement is limited to a few hundred feet around rig and cable is connected to the measurement-while-drilling shack ("MWD").

Electromagnetic telemetry (also "EM-Telemetry" or "EM Telemetry") transmits information and data from a downhole tool (also referred to herein as a "tool" or "EM-tool" or "EM tool") placed in a borehole to an acquisition system located at the earth's surface and also sends commands from the earth to the downhole tools. Information and data transmitted to the surface can contain tool position, orientation in the borehole as well as a variety of formation evaluation measurements which are used in some applications to guide the drilling direction and optimize the well placement in the pay zone. A modulated current can be injected by the tool into the formation through the metal in the drilling string and the bottom hole assembly ("BHA") that is in contact with the rock in the borehole. A section of the BHA can act as one electrode and the upper section of the BHA and drill string can act as the other electrode. The separation between sections consists of an insulating gap. Signal is received at the earth's surface by measuring the voltage between two points, typically between the well head and a second electrode connected to the ground a few hundred feet away. The voltage signal is acquired, demodulated and decoded, providing the information to the user to make drilling and steering decisions and/or adjustment of drilling parameters including, but not limited to, drilling depth, drilling rate, drilling rotation, rotation speed, torque, thrust pressure, rotating pressure, injection fluid flow rate and pressure, x and y inclination, reflected vibration, drilling fluid composition, fluid density, viscosity, fluid loss and the like. Also, data and information including, but not limited to these drilling parameters, can be wirelessly streamed to the data acquisition system.

As noted above, a limitation of prior art EM-telemetry systems is that the signal amplitude received at surface can be very small respect to the electrical noise picked up by the electrodes. Under high noise conditions, the received signal can be corrupted, consequently demodulation and decoding result in erroneous or missing information. As also noted above, a second limitation of prior art EM-Telemetry systems is that the field crew must nail a set of electrode rods, also referred to as "stakes," deep in the ground for every rig and lay down several hundred feet of wire from the stakes into the acquisition system which is typically located in a measurement-while-drilling shack near the rig. This frequently involves routing wires through roads, local rig vehicle traffic, fences etc. The setup is time consuming, requires testing for proper ground connection each time, complicated logistics, increased safety risk exposure and leads to cable damage and unexpected failures during the job. As described herein, the electrodes can be either deployed at surface, downhole or in ocean or other large body of water.

As used herein, the term "electrode" includes, but is not limited to, a surface electrode, a downhole electrode and an ocean electrode. The surface electrode can be, for example, an observation well well-head, a capacitive electrode or a magnetometer and the like. The downhole electrode can be a metallic ball, an electric insulating gap or a magnetometer and the like. The metallic ball can be in contact with casing or insulted form the casing. The ocean electrode is a metallic rod or magnetometer and the like. The EM-Telemetry signals can be measured using any combination of two electrodes. As further described herein, to obtain a significant or maximum amount of information, two pairs of electrodes should be deployed, and they should be installed substantially perpendicular to each other.

Hence, the present disclosure provides methodologies to enable EM-Telemetry decoding in electromagnetic ("EM") unfriendly environments, particularly instances where the downhole signal can be small and the noise can be high relative to the signal. In contrast to prior art methods, the methods described herein eliminate the need to deploy stakes (also referred to sometimes as "electrodes") and hard wire cables at each rig location.

A main source of electrical noise which impedes EM-telemetry is often generated by the electrical equipment around the rig. One source of noise is produced by current loops in the ground between different pieces of equipment or as referred to herein as "rig noise." When the voltage is measured between a pair of stakes, separated for example at 500 feet from each other, the voltage contains both the signal of interest received from the downhole tool and rig noise. Rig noise amplitude is large near the rig area (where the ground loop currents circulate) and is attenuated as it is measured at a distance away from the rig. When a measurement is made at a significantly large distance from the rig (several hundred to thousands of feet) the rig noise becomes insignificant.

FIG. 1 illustrates how the cable 144 hundreds of feet long and the stakes (referred to herein also as "electrodes") 6 can be placed around a rig 14 infrastructure during job setup where stake placement is limited to a few hundred feet around rig and cable is connected to the measurement-while-drilling shack ("MWD") 142 because of fencing 146, a road 218 and the like.

Figure 2:
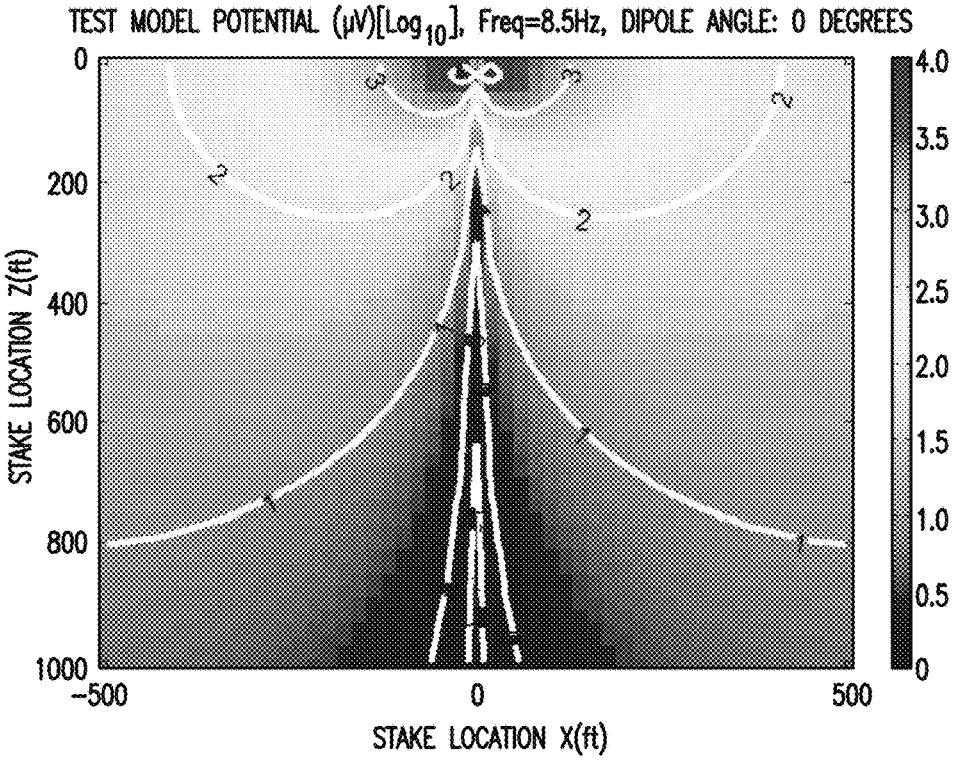
FIG. 2 shows noise propagation as a function of depth and radial distance from the noise source.
Figure 3:
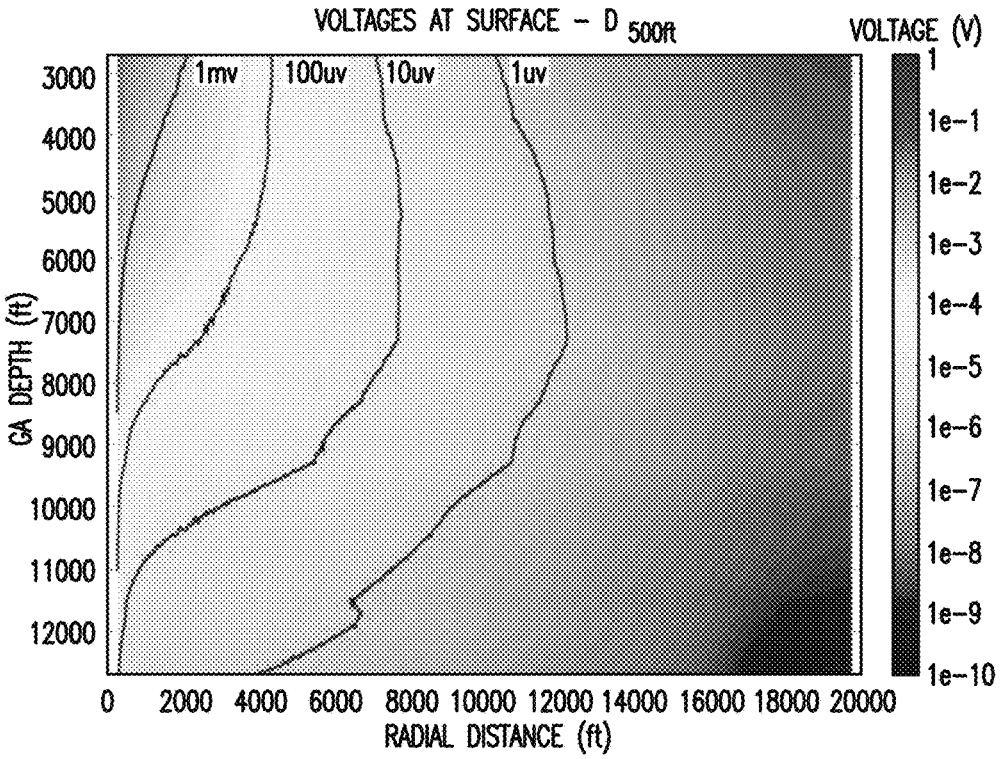
FIG. 3 shows the EM-telemetry signal decay of a downhole tool as a function of radial distance from the rig and tool depth. The EM-telemetry signal amplitude from the downhole tool is attenuated as the distance increases radially from the rig and as the tool is positioned at a greater depth. The black contour lines show that as the tool moves deeper in the well, the attenuation rate is lower as the signal is measured away from the rig.

As shown in FIG. 2, rig noise decay is a function of radial distance from the rig and is independent of the BHA depth position. At the same time, low frequency electromagnetic signals are transmitted by the downhole tool and travel through earth formations to the earth's surface, producing signal that can be measured between a pair of stakes placed at the surface. As the BHA drills deeper, signal from the downhole tool is attenuated as it travels to the surface and the voltage measured between two stakes diminishes. The rate of signal attenuation versus depth follows a different profile as the voltage measurements are made going away from the well. When measurements are made away from the rig, the signal decay rate is smaller. FIG. 3 shows tool signal decay as a function of radial distance from the rig and tool depth. The black contour lines show the attenuation rate is lower as the signal is measured away from the rig. As such, there is an optimal location at a significantly far distance from the well where rig noise is minimized and the downhole signal (while greatly reduced) is measureable. In that configuration, the signal to noise ratio (also referred to herein as "SNR") is large, enabling the decoding of EM-telemetry data which otherwise would not be possible.

Figure 4:
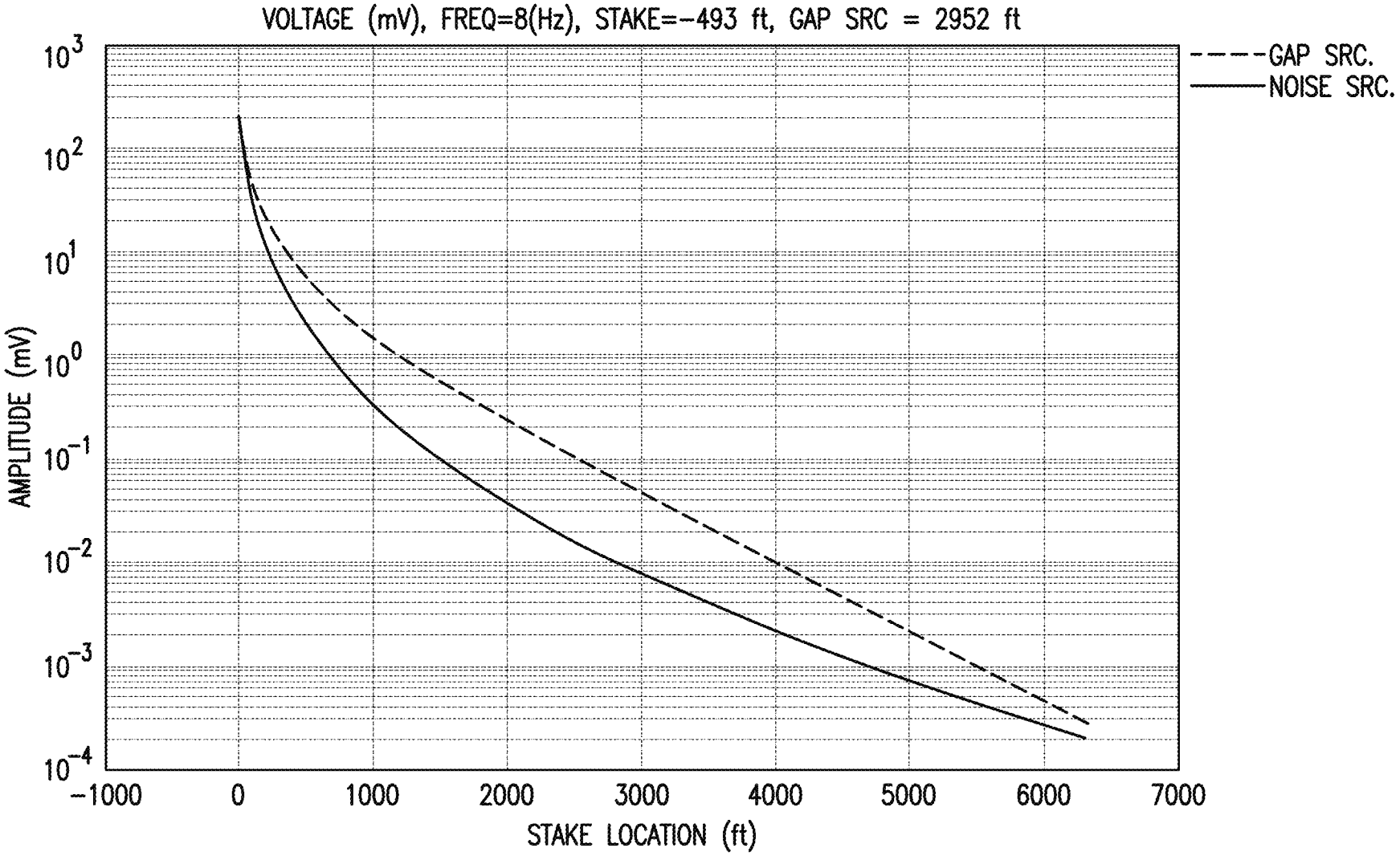
FIG. 4 illustrates downhole signal amplitude and rig noise amplitude at radial distance from the rig (plot for gap placed at depth approximately 3000 feet).

FIG. 4 illustrates, at one depth, the expected received signal at surface from the downhole tool and its decaying attenuation as it is measured away from the rig. It also shows the rig noise amplitude and the noise attenuation as the distance from the rig increases. In the near proximity of the well (few hundred feet), the noise and signal have both been observed to have high amplitude of similar order. At relatively far distance (i.e., 3000 feet), the rig noise has decayed significantly while the downhole signal has been reduced only slightly.

Diversity receivers and numerical methods of signal processing are described. Diversity receivers and numerical methods of signal processing have been described. For example, in U.S. Pat. Nos. 6,657,597 and 7,268,696, Rodney et al. teach EM telemetry systems that are in use while a well is being drilled where an adaptive filter is used to remove noise from the received EM signal. See, U.S. Pat. No. 6,657,597, Col. 4, line 58 through Col. 7. Line 17, and FIGS. 1, 2 and 3, incorporated herein as reference. In U.S. Pat. No. 7,151,466, Gabelmann et al., teach a data-fusion receiver where an ultra-low frequency electromagnetic telemetry receiver which fuses multiple input receive sources to synthesize a decodable message packet from a noise corrupted telemetry message string. Gabelmann et al. explain ultra-low frequency electromagnetic waves (ULF EM) waves and identifies a variety of receivers employed as the telemetry receiver. See, U.S. Pat. No. 7,151,466 generally and particularly U.S. Pat. No. 7,151,466 at Col. 1, line 29 through Col. 3, line 40 incorporated herein by reference. Likewise, in U.S. Pat. No. 7,243,028, Young et al. teach methods and apparatus for reducing noise in a detected electromagnetic wave used to telemeter data during a wellbore operation. In one embodiment, two surface antennae are placed on opposite sides of the wellbore and at the same distance from the wellbore. The signals from the two antennae are summed to reduce the noise in the electromagnetic signal transmitted from the electromagnetic downhole tool. U.S. Pat. No. 7,243,028, Col. 4, 1. 51 through Col. 7, 1. 55 incorporated by reference. Finally, in U.S. Pat. No. 7,268,696 Rodney et al. teach directional signal and noise sensors for borehole EM telemetry systems.

Figure 5:
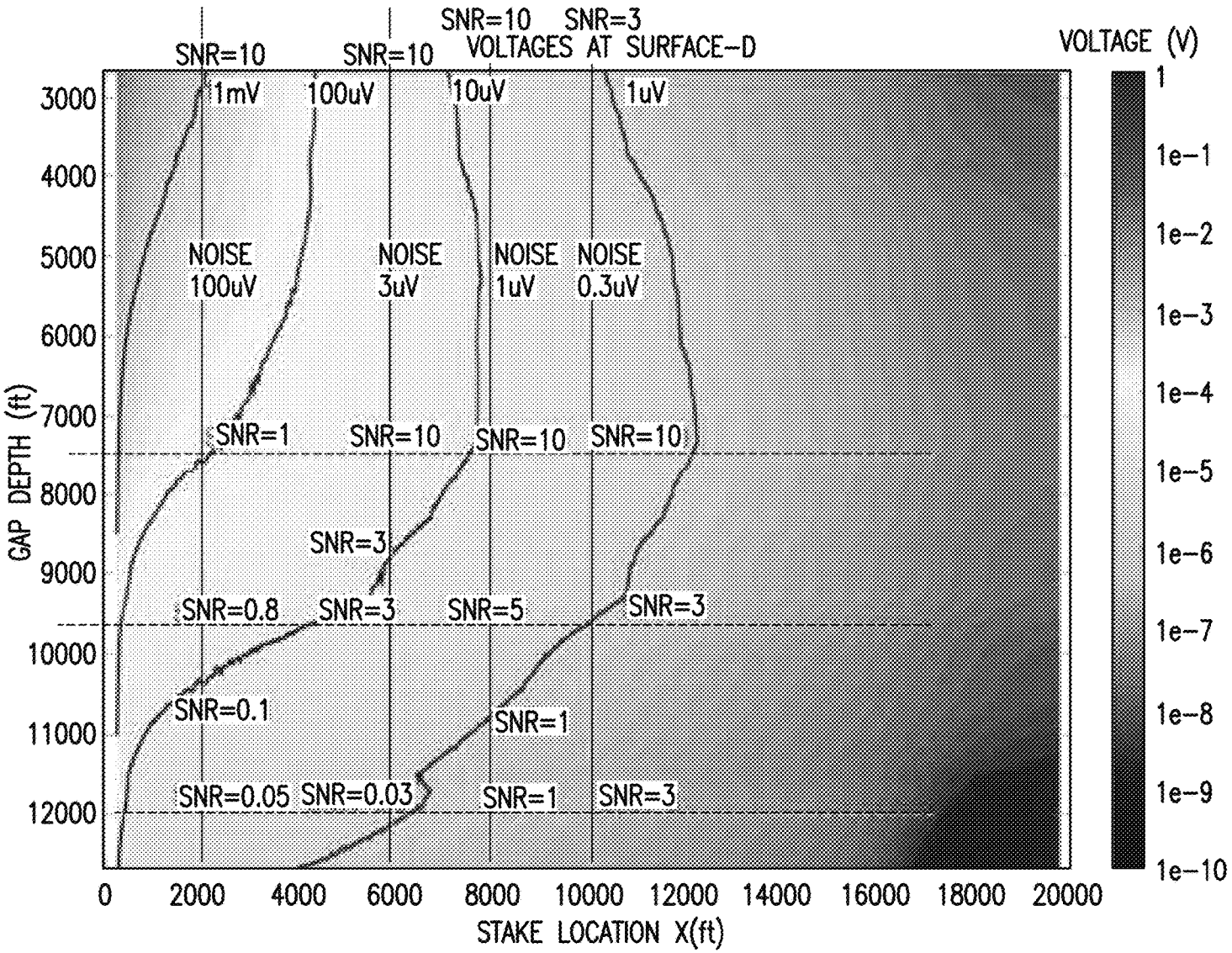
FIG. 5 shows the signal to noise ratio computed at a range of radial distance points from the well and EM-tool at different gap depths.

FIG. 5 shows the signal to noise ratio computed at selected radial distance points from the well and different gap depths. While the tool is at shallow depths, the SNR is high for radial distance away from the well even in instances where electrode pair is placed within 2000 feet from the well. However, when the tool is at a much greater depth (beyond 7000 feet for example), the SNR drops for stake locations near the well since the rig noise is high and tool signal is small. However, the SNR is larger at farther locations where the stakes are 6000 feet, 8000 feet, etc. . . . away from the well. This example is a vertical well and the SNR and signal amplitude are for illustration purposes. Actual values vary on a case by case basis depending on the formation resistivity, and rig noise amplitude and source.

As to limitations presented when laying stakes 6 at each rig 14 and running wires and cable 144 as described in the background section, here, logistics are further complicated if there is a need to place the electrodes 6 significantly away (in the order of thousands of feet) from the rig in an effort to reduce the rig noise. As such, the methodology described herein includes installing an array of electrode pairs which is located a significant distance from the rig 14. Each set of electrodes forms a node 12 (or cell) that digitizes voltage and wirelessly streams the data/information to an acquisition system. This methodology eliminates the time, cost, and risks in routing extra-long cables and permits placing the electrodes 6 far away from the rig to improve the signal to noise ratio. Permanent or semi-permanent installations of the nodes 12*a*, 12*b*, 12*c*, 12*e*, 12*f* can be set up in a drilling area of 500 feet to 2 to 5 square miles. Numerous sensing nodes, each having an electrode pair (pair of stakes) can be deployed and wirelessly stream data, enabling noise cancellation algorithms and further improve SNR. Data from multiple tools running in different pads can be received simultaneously and EM downlinks can be transmitted from a single location to multiple tools downhole. The EM downlink can refer to a communication signal, such as telecommunication signal, and/or information that the signal conveys. Each tool (not shown) can be assigned a frequency channel and an identifier and synchronized, if desired or required. Further, as the downhole tool drills a lateral well (typically several thousand fee long), the EM signal amplitude will be reduced as the tool moves radially from the node. At the same time, the signal will increase as the tool approaches another node located in the direction that the tool is drilling. In the array deployed in the drilling area, certain nodes receive stronger signal than other nodes at different time as the downhole tool drills through the well. Therefore, signal is likely to increase in one or more nodes.

Figure 6:
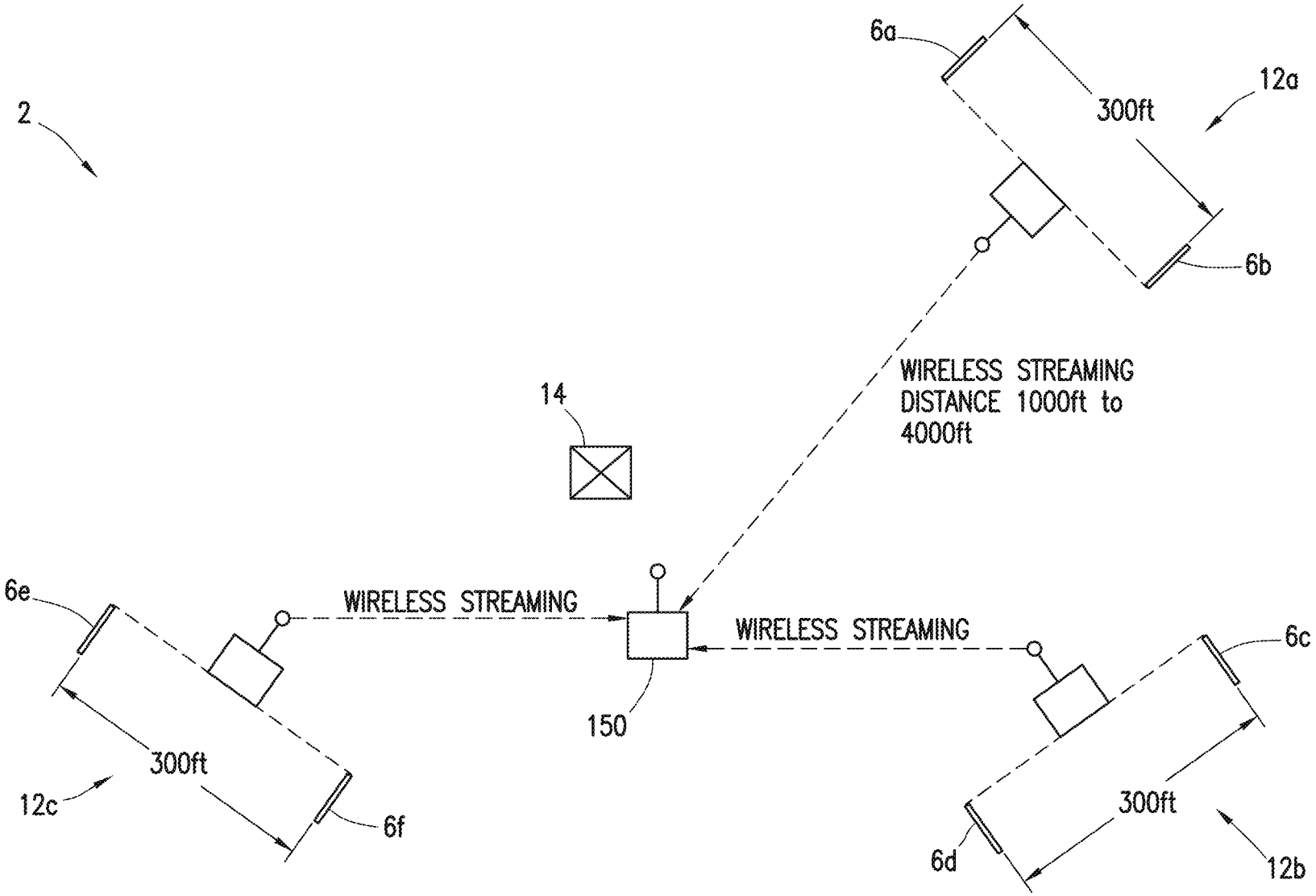
FIG. 6 illustrates one embodiment of the EM-telemetry remote wireless remote sensing network described herein. Electrodes are placed in pairs and significantly away from the rig site. An array is installed in the area and data streamed to an acquisition system.
Figure 7:
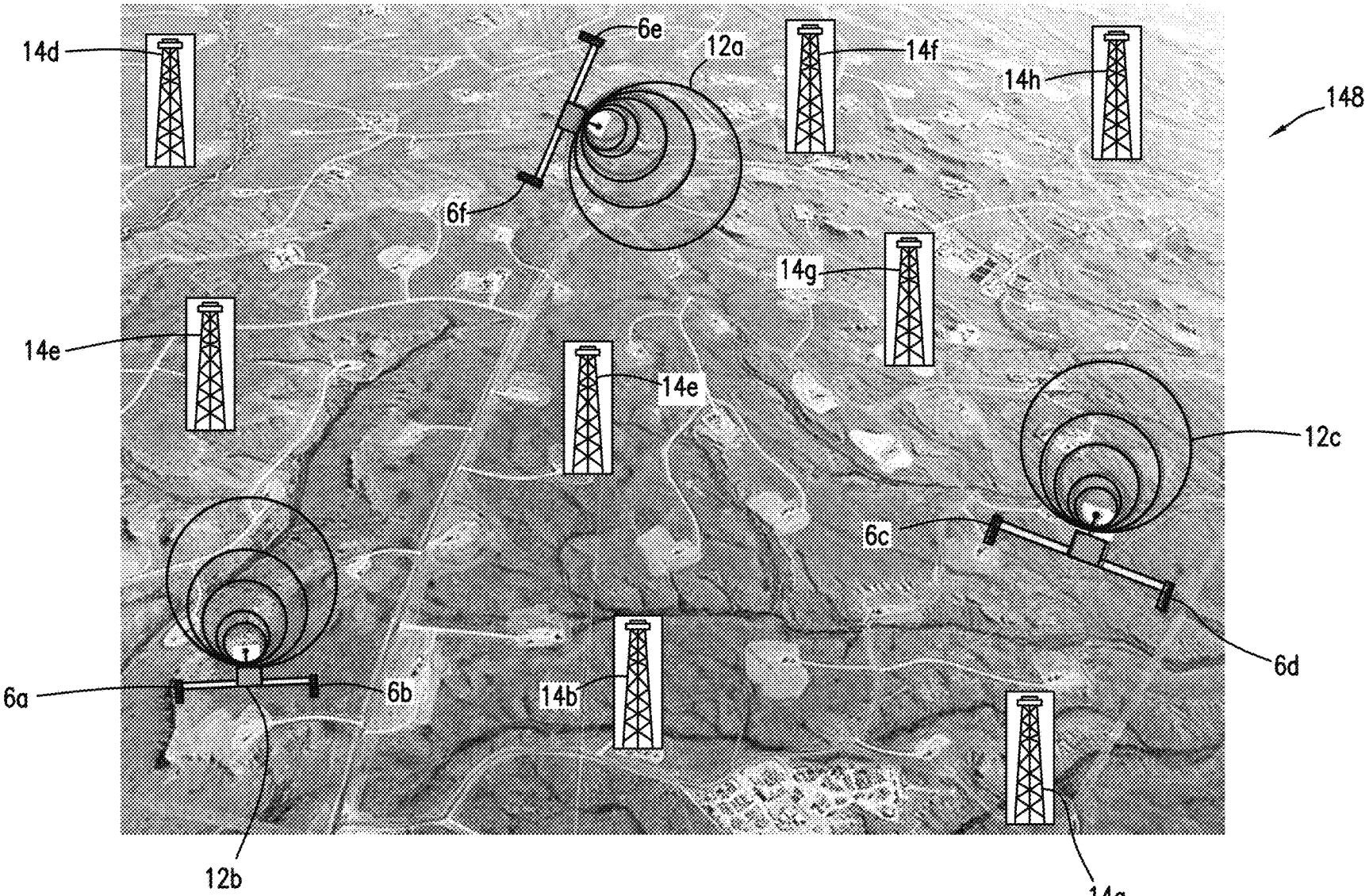
FIG. 7 illustrates nodes streaming electromagnetic ("EM") sensed data to a number of rigs in the area.

FIG. 6 illustrates one embodiment of an EM-telemetry remote sensing wireless network 2, also referred to herein sometimes as an EM-telemetry remote sensing wireless system. FIG. 7 illustrates three nodes 12*a*, 12*b*, 12*c* streaming EM sensed data to one or more rigs 14 (rigs 14*a*, 14*b*, 14*c*, 14*d*, 14*e*, 14*f*, 14*g*, and 14*h* in FIG. 7) in the drilling area (sometimes referred to as "the area."). As described below, electrodes 6*a*, 6*b*, 6*c*, 6*d*, 6*e*, and 6*f* are placed significantly away from the rigs 14 to minimize rig noise pick-up. Data can be streamed into a central data acquisition system 150 or to a number of acquisition system where data is processed and can be utilized.

The Noise Reduction Manager

In electromagnetic telemetry, the presence of noise from unwanted electromagnetic sources can threaten the reliability of a telemetry uplink. Such noise can be generated by a wide variety of devices associated with electromagnetic energy including electric power generators, electronic power controllers and converters, mud motors, wellhead equipment, AC units, vehicles, welding equipment, consumer electronics. Noise can also be generated by surrounding the environment such power transmission systems, buildings or nearby construction of the same.

As described in U.S. patent application Ser. No. 14/517,197, an array noise reduction manager (also referred to sometimes as the "noise reduction manager") can be used in the EM-telemetry remote sensing wireless network system and can be configured to receive measurements from several sensors on one or more tools or nodes. As described herein, the noise reduction manager applies a selected de-mixing vector to filter the noise sources from the measurements and improves the signal to noise ratio of a telemetry signal in the measurements. The noise reduction manager can improve a signal to noise ratio of a signal through use of an interface to receive the signal, which includes information associated with an operating condition from two or more sensors on one more tools. The noise reduction manager also includes a noise reduction module to simultaneously remove noise associated with several noise sources from the received signal through use of a de-mixing vector. The noise reduction manager is capable of directing a processor to receive signals from two or more sensors and apply a selected de-mixing vector to filter one or more noise sources from the signals. The term "noise reduction" as used herein includes a range of signal noise reduction, from decreasing some of the noise in a signal to cancellation of noise in a signal. U.S. patent application Ser. No. 14/517,197, unpublished, ¶¶ [0001] to [0042] incorporated herein by reference.

Array noise reduction can be accomplished through the use of multiple sensors on one or more tools and in conjunction with the array noise reduction manager utilizing a de-mixing vector. In one possible aspect, a certain number of sensors ("N") are used to process N−1 noise sources from a desired signal. In another possible aspect, different noise sources can be jointly removed rather than sequentially removed from the desired signal. Id. ¶ [0020].

Array noise reduction as described herein is useful in electromagnetic ("EMAG" or "EM") telemetry, including scenarios where EM telemetry is employed in conjunction with Measuring While Drilling ("MWD") or Logging While Drilling ("LWD") operations and MWD tools, LWD tools and in underbalanced drilling conditions and/or when gas is used instead of mud as drilling fluid. Array noise reduction reduces environmental noise (or noise due to the environment) in EM telemetry and improves the reliability of associated uplink telemetry, even when power constraints result in a signal power is measured at a well surface and smaller than environmental noise present at a well site. Id. at ¶¶ [0021] & [0022].

Figure 8:
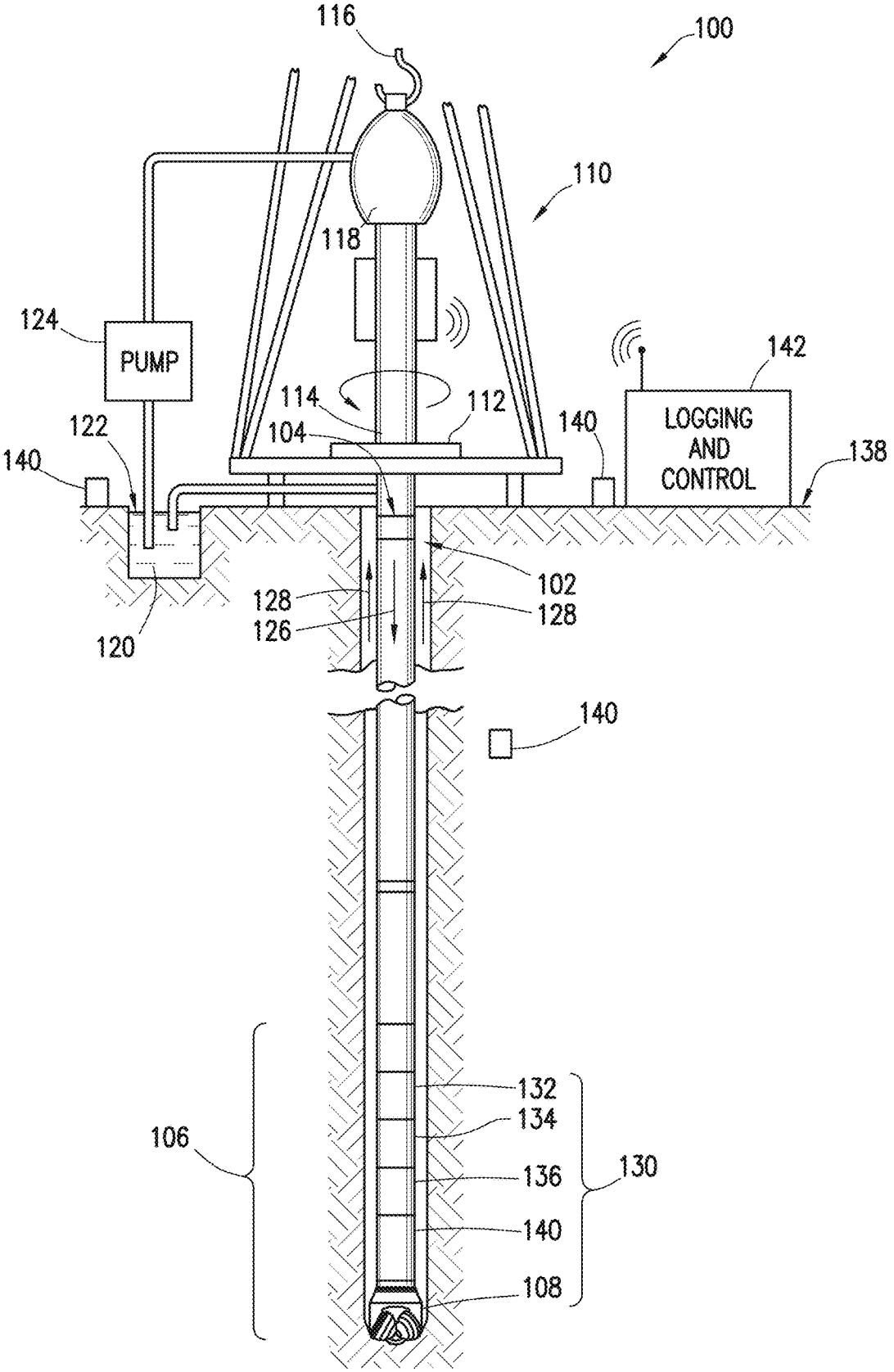
FIG. 8 illustrates an example well site in which embodiments of an array noise reduction manager can be employed.

FIG. 8 illustrates a well site 100 in which embodiments of the noise reduction manager can be employed. Well site 100 can be onshore or offshore. In this example system, a borehole 102 is formed in a subsurface formation by rotary drilling; however, the noise reduction manager can be employed in well sites where directional drilling is being conducted. A drill string 104 is suspended within the borehole 102 and has a bottom hole assembly ("BHA") 106 having a drill bit 108 at its lower end. The surface system can have platform and derrick assembly 110 (also referred to herein as a "rig") positioned over the borehole 102. The assembly 110 can include a rotary table 112, kelly 114, hook 116 and rotary swivel 118. The drill string 104 is rotated by the rotary table 112, energized by means not shown, which engages the kelly 114 at an upper end of the drill string 104. The drill string 104 is suspended from the hook 116, attached to a traveling block (not shown), through the kelly 114 and a rotary swivel 118 which permits rotation of the drill string 104 relative to the hook 116. A top drive system can also be used. Id. at ¶¶ [0023] & [0024].

The surface system can includes drilling fluid or mud 120 stored in a pit 122 formed at the well site 100. A pump 124 delivers the drilling fluid 120 to the interior of the drill string 104 via a port in the swivel 118, causing the drilling fluid 120 to flow downwardly through the drill string 103 as indicated by the directional arrow 126. The drilling fluid 120 exits the drill string 103 via ports in the drill bit 108, and the circulates upwardly through the annulus region between the outside of the drill string 104 and the wall of the borehole 102, as indicated by the directional arrows 128. The drilling fluid 120 lubricates the drill bit 108 and carries formation cuttings up to the surface as the drilling fluid 120 is returned to the pit 122 for recirculation. The BHA 106 includes a drill bit 108 and a variety of equipment 130 such as a logging-while-drilling (LWD) module 132, a measuring-while-drilling (MWD) module 134, a roto-steerable system and motor (not shown), and/or various other tools. Id. at ¶¶ [0025] & [0026].

In one possible implementation, the LWD module 132 is housed in a special type of drill collar, as is known in the art, and can include one or more of a plurality of logging tools including but not limited to a nuclear magnetic resonance (NMR) tool, a directional resistivity tool, and/or a sonic logging tool. It will also be understood that more than one LWD and/or MWD tool can be employed. The LWD module 132 can include capabilities of measuring, processing, and storing information, as well as for communicating with the surface equipment. Id. at ¶ [0027].

The MWD module 134 can also be housed in a special type of drill collar, as is known in the art, and include one or more devices for measuring characteristics of the well environment, such as characteristics of the drill string and drill bit. The MWD tool can further include an apparatus (not shown) for generating electrical power to the downhole system. This may include a mud turbine generator powered by the flow of the drilling fluid 120, it being understood that other power and/or battery systems may be employed. The MWD module 134 can include one or more of a variety of measuring devices known in the art including, for example, a weight-on-bit measuring device, a torque measuring device, a vibration measuring device, a shock measuring device, a stick slip measuring device, a direction measuring device, and an inclination measuring device. Id. at ¶ [0028].

Data and information can be received by one or more sensors 140. The sensors 140 can be located on, above, or below the surface 138 in a variety of locations. In one possible implementation, placement of sensors 140 can be independent of precise geometrical considerations. Sensors 140 can be chosen from any sensing technology known in the art, including those capable of measuring electric or magnetic fields, including electrodes (such as stakes), magnetometers, coils, etc. Id. at ¶ [0029].

In one possible implementation, the sensors 140 receive information including LWD data and/or MWD data, which can be utilized to steer the drill bit 108 and any tools associated herewith. In one implementation the information received by the sensors 140 can be filtered to decrease and/or cancel noise at a logging and control system 142. Logging and control system 142 can be used with a wide variety of oilfield applications, including a logging-while-drilling, artificial lift, measuring-while-drilling, etc. . . . . Also, logging and control system 142 can be located at surface 138, below surface 138, proximate to borehole 102, remote from borehole 102, or any combination thereof. Id. at ¶ [0030].

Alternatively, or additionally, the information received by the sensors 140 can be filtered to decrease and/or cancel noise at one or more other locations, including any configuration known in the art, such as in one or more handheld devices proximate and/or remote from the well site 100, at a computer located at a remote command center, in the logging and control system 142 itself, etc. Id. at ¶ [0031].

Figure 9:
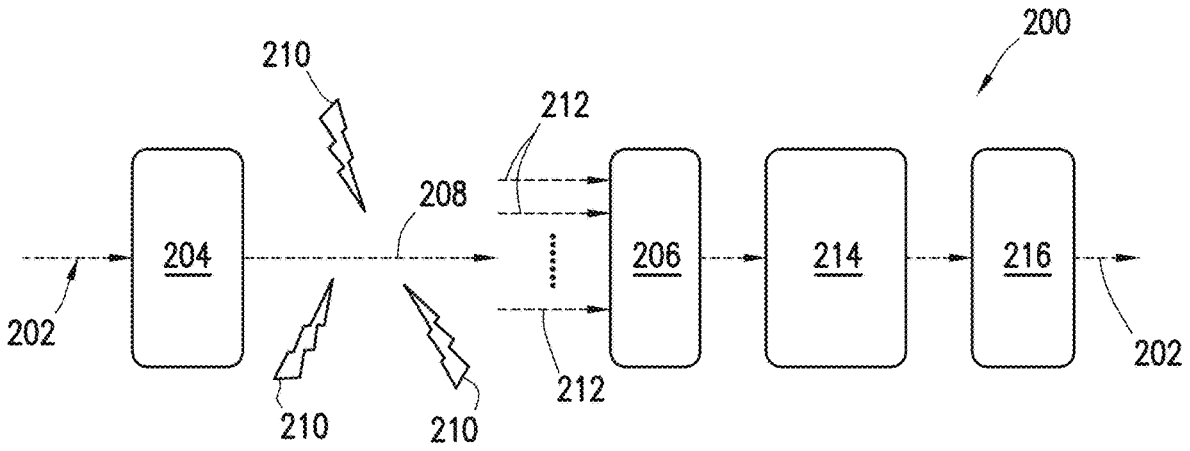
FIG. 9 illustrates an example global uplink chain that can be used with implementations of the array noise reduction manager.

FIG. 9 illustrates an example global uplink chain 200 that can be used in conjunction with implementations of sensor noise reduction. In one possible implementation, information 202 is collected or produced by equipment, such as equipment 130. In one possible aspect, information 202 can be represented as binary information. Id. at ¶ [0032] incorporated herein by reference. Information 202 can be modulated at a modulator 204 and transmitted to a demodulator 206. In one possible embodiment, modulator 204 produces a signal 208, such as an electromagnetic signal that includes information/data 202 that is transmitted using any method and equipment known in the art. Signal 208 can be susceptible to one or more noise sources 210 during transmission. Noise sources 210 can include a wide variety of devices associated with electromagnetic energy such as, for example, mud motors, well heads, AC units, vehicles, welding operations, consumer electronics, electric perturbations from external sources for which no direct mitigation can be achieved and/or be caused by other environmental causes. Id. at ¶ [0032] & [0033].

In one possible implementation, signal 208 with accompanying noise is received by sensors, such as sensors 140. The sensors provide measurements 212 corresponding to signal 208 with accompanying noise, to demodulator 206. Signal 208 with accompanying noise from noise sources 210, is demodulated at demodulator 206. In one possible aspect, a noise reduction manager 214 can be employed to apply the concepts of array noise reduction to remove or reduce noise from demodulated signal 208 to produce a denoised signal. Information (also referred to herein as "data") 202 can be decoded from the denoised signal by a symbol estimator 216 using any symbol estimation techniques known in the art. Id. at ¶ [0034].

Figure 10:
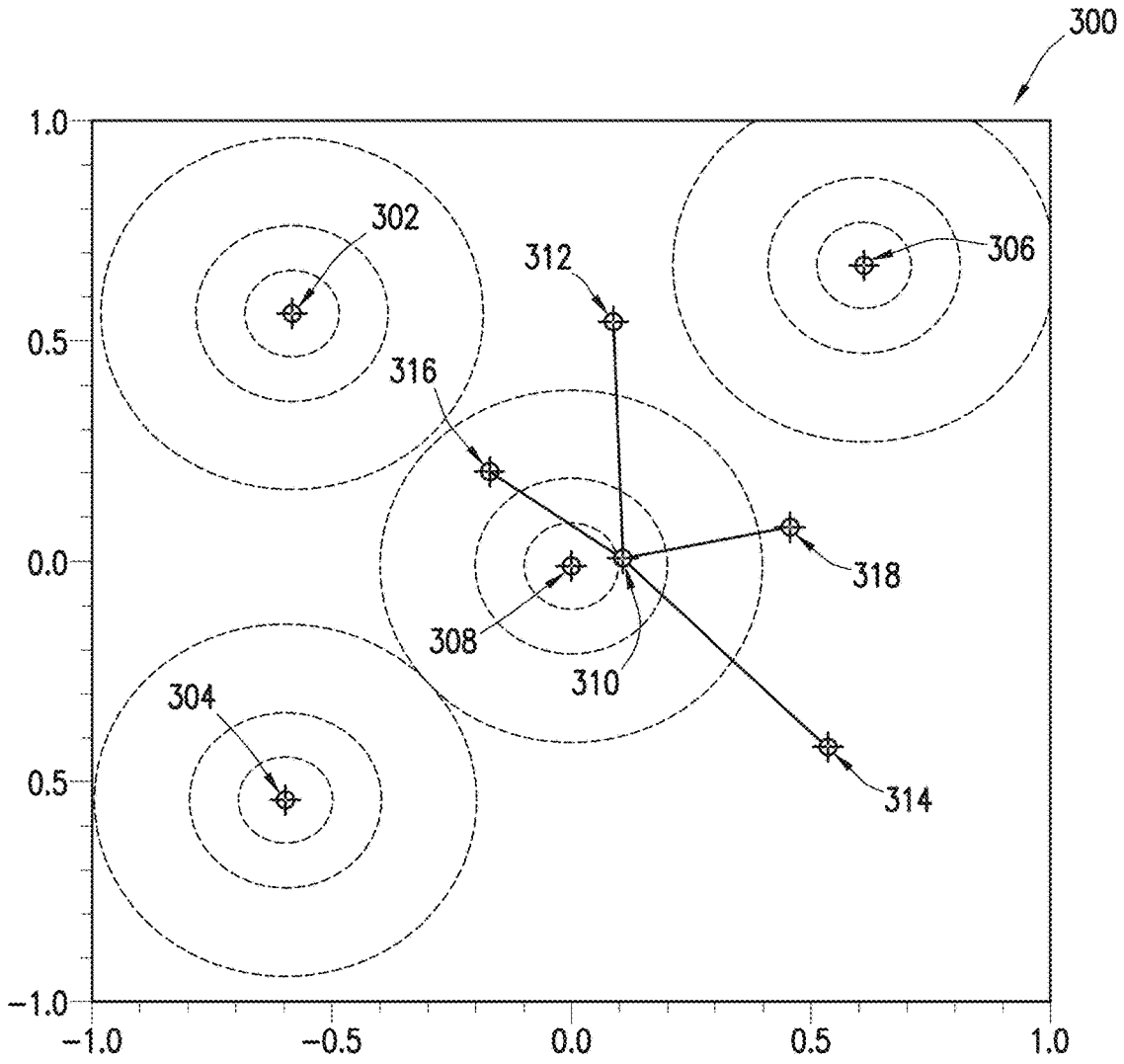
FIG. 10 illustrates an example observation model in accordance with implementations of the array noise reduction manager.

FIG. 10 illustrates an example observation model 300 in accordance with implementations of noise reduction. As shown, four electromagnetic sources 302, 304, 306, and 308 are present, though it will be understood that more or fewer electromagnetic sources can also be used. Electromagnetic sources 302-308 can be represented by "$so_1$ (t)", "$so_2$(t)", "$so_3$(t)" and "$so_4$(t)", respectively, where t is the time. In one possible implementation, source 302 can be a telemetry source producing a signal to be extracted while sources 304-308 can be noise sources. Measurement of the signal from source 302 can be achieved using sensors 140, such as metal rods, coils, magnetometers, or any measurement device sensitive to an electric or magnetic field, located on the surface or in the well, for instance an electrode sensing the potential deep into the ground inside the casing. In one possible implementation, the measurements can be obtained by amplification of the difference of electric potential measured between a "ref" sensor 310 (denotable as ref(t)) and other sensors 312, 314, 316, 318 (which can be denoted respectively as "$se_1$(t)", "$se_2$(t)", "$se_3$(t)", "$se_4$(t)" such that a voltage $v_i$(t) measured at surface 138 can be proportional to a difference of potential $v_i$ (t)=G. ($se_i$(t)−ref(t)), where G is a measurement gain. Id. at ¶¶ [0035] & [0036].

In one possible implementation, any signal obtained at surface 138 which is proportional to the electric or magnetic field on a surface location or proportional to the difference of the electric field or magnetic field between two surface locations can be denoted as $v_i$(t). In one possible aspect, according to the superposition principle, the relationship between the signals measured and the sources can be written as the following linear relationship:

$$\begin{bmatrix} v_1(t) \\ \vdots \\ v_i(t) \end{bmatrix} = \begin{bmatrix} m_{11} & \dots & m_{1j} \\ \vdots & & \vdots \\ m_{i1} & \dots & m_{ij} \end{bmatrix} \begin{bmatrix} so_1(t) \\ \vdots \\ so_j(t) \end{bmatrix}$$

If the mixing matrix [$m_{ij}$] is invertible, the sources can be recovered using the inverse matrix (or pseudoinverse in the case i>j) as follows:

$$\begin{bmatrix} so_1(t) \\ \vdots \\ so_j(t) \end{bmatrix} = \begin{bmatrix} m_{11} & \dots & m_{1j} \\ \vdots & & \vdots \\ m_{i1} & \dots & m_{ij} \end{bmatrix}^{+} \begin{bmatrix} v_1(t) \\ \vdots \\ v_i(t) \end{bmatrix} = \begin{bmatrix} d_{11} & \dots & d_{1i} \\ \vdots & & \vdots \\ d_{j1} & \dots & d_{ji} \end{bmatrix} \begin{bmatrix} v_1(t) \\ \vdots \\ v_i(t) \end{bmatrix}$$

In one possible embodiment, the symbol "+" can denote either the inverse matrix (if i=j) or the pseudoinverse matrix (if i>j). In one possible implementation, the matrix [$d_{ij}$] can be called the demixing matrix.

In one possible embodiment, the electromagnetic source $so_1$ (t) can be recovered using following equation:

$$so_1(t) = \sum_{k=1}^{i} d_{1k} \cdot v_k(t)$$

The vector [$d_{1i}$] can be referred to as the "demixing vector".

In one possible implementation, at surface 138 one or more measurements $v_i$(t) from sensors 140 can be converted to a constellation space using demodulation (such as low pass filtering and/or down sampling) at the rate of one sample per symbol. The samples obtained from the measurement $v_i$(t) at the end of this procedure can be denoted $z_i$ [n] where n is the symbol index. For example, in the constellation domain, the samples of the telemetry signal may be concentrated around the constellation centers of the modulation. Id. at ¶¶ [0038] & [0043].

FIG. 11 shows example constellation centers 400 which might be expected in one implementation of the array noise reduction for a Quadrature Phase-Shift Keying (QPSK) modulation. In FIG. 11, four constellation centers 400 are shown, however it will be understood that more or less constellation centers can also be used. Id. at ¶ [0045] Noise reduction in EM telemetry can be formulated as a reduction and/or minimization exercise under constraint. See U.S. application Ser. No. 14/517,197, unpublished, filed Oct. 17, 2014 at ¶¶ [0050] to [0062], incorporated herein by reference.

FIG. 12 illustrates an example data learning method 1000 that can be used with embodiments of sensor array noise reduction. As shown an observation matrix z can be formed from samples 1002 of signals $z_i$[n] 1004 such as signals 208. Signals 1004 can include, for example, information received by sensors 140 and can have already been demodulated, such as by demodulator 206. In an embodiment, a sliding window can be employed to access samples 1002 for use in estimating denoising parameters. In one aspect, the samples 1002 correspond in time (i.e., the samples are associated with measurements made by sensors 140 during the same time frame). In one implementation, a dispersion metric can be estimated for one or more demixing vectors in a demixing vector database 1008.

Figure 13:
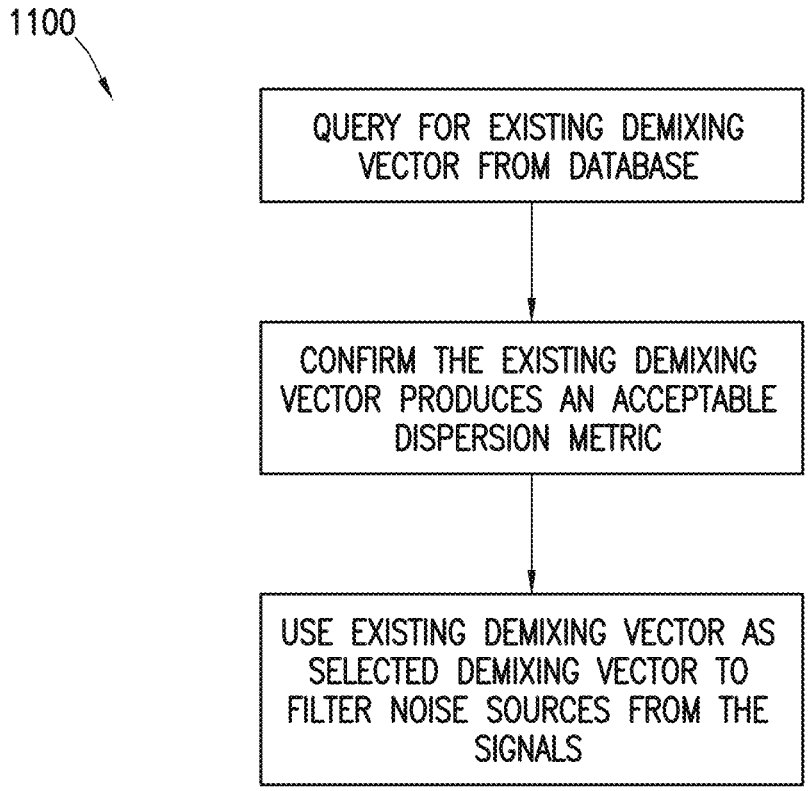
FIG. 13 illustrates an example method associated with the array noise reduction manager.
Figure 14:
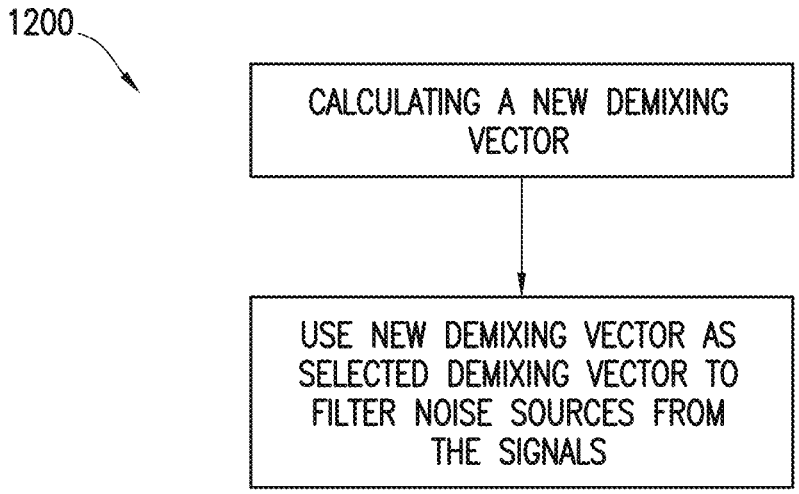
FIG. 14 illustrates an example method associated with the array noise reduction manager.

FIG. 13 illustrate an example method 1100 for selecting and using a demixing vector. FIG. 14 illustrates another example method 1200 with sensor array noise reduction.

FIGS. 12-14 illustrate example methods for implementing aspects of the noise reduction manager. The methods are illustrated as a collection of blocks and other elements in a logical flow graph representing a sequence of operations that can be implemented in hardware, software, firmware, logic or any combination thereof. The order in which the methods are described is not intended to be construed as a limitation, and any number of the described method blocks can be combined in any order to implement the methods, or alternate methods. Additionally, individual blocks and/or elements may be deleted from the methods without departing from the spirit and scope of the subject matter described therein. In the context of software, the blocks and other elements can represent computer instructions that, when executed by one or more processors, perform the recited operations.

Further, it is understood that computations in array noise reduction, including those discussed in FIGS. 12-14, can be done in baseband and/or at the rate of carrier's frequency. Further, it will be understood that a variety of frame structures and error correcting codes can be used. Also, the nature of modulation may also be accounted for, i.e. a probability density function of the modulation can be utilized to provide information to discriminate a desired signal from noise in sensor array noise reduction. Moreover, a linear combination of all measurements made, such as measurements made by sensors 140, may be used in the array noise reduction manager to generate a de-noised signal. See U.S. application Ser. No. 14/517,197, filed Oct. 17, 2014, unpublished, ¶¶

[0065] to [0080], incorporated herein by reference. An example computing device for hosting the array noise reduction manager 10 can contain a processor and memory can be configured to implement various embodiments of array noise reduction, including hosting one or more databases, and one or more volatile data storage media. See U.S. application Ser. No. 14/517,197, filed Oct. 17, 2014, unpublished, ¶¶ [0081] to [0092], incorporated herein by reference.

Stake Placement Optimization & Noise Mapping

U.S. Patent Application No. 62/255,012 filed on Nov. 13, 2015 describes methodologies for placement of electrodes that can determine the spatial distribution of a signal caused by generating an electromagnetic field in an instrument disposed in a drill string. In these methods, the electromagnetic field includes encoded measurements from at least one sensor associated with the instrument. Voltages induced by noise are measured across at least one pair of spaced apart electrodes placed at a plurality of position at a surface location. A spatial distribution of noise is estimated using the measured voltages. Positions for placement of at least two electrodes are selected using the spatial distribution of signal and the spatial distribution of noise. U.S. Pat. Application No. 62/255,012 filed Nov. 13, 2015 ¶ [0008], [0031], and [0032] incorporated herein by reference.

More specifically, an electrode is placed radially away from another electrode placed at the wellhead. Voltages are modeled as a function of EM signal transmitter depth from 3,000 feet to 12,000 feet deep. Id. at ¶ [0033] incorporated by reference. The voltage decreases as the transmitter depth increases. Another radial configuration places two electrodes further away from the well head but aligned with the well. Id. at ¶ [0034] incorporated by reference. In this configuration, the radial position of the well is defined as zero distance.

In order to maximize the EM signal (sometimes referred to herein as "signal") detected at the surface, the electrode pair should be along a line extending radially outward form the well head. The strongest signal is found closest to the well head. The most suitable distance, however, depends on the maximum intended depth of the wellbore and the electrical properties of the geological layers between the surface and the transmitter. This distance may be computed prior to drilling using one or any number of finite element analysis. Id. at ¶ [0035] incorporated by reference. In short, voltage detected between the well head and an electrode is larger than the voltage detected between a pair of electrodes that are both spaced away from the well head. However, the well head is the place of the largest noise amplitude. Id.

Therefore, mapping of noise at the surface is recommended to identify noise source through various methods (including the 4-parameter method) and to determine areas of smaller noise that may be suitable for placement of the electrodes. Id. at ¶¶ [0036] through [0039] incorporated by reference. Furthermore, combining the results from the signal map and the noise map can enable the generation of a SNR map. Id. at ¶ [0043] incorporated by reference. The SNR can be generated by dividing the signal potential map by the noise potential map, that is, the signal amplitude value by the noise amplitude value, or by dividing a component of the electric field corresponding to the signal by a component of the electric field corresponding to the noise. Id.

Diversified Receivers for EM Telemetry

In a system containing a signal and coherent noise, it is desirable to eliminate the coherent noise from the received waveform. In the case of EM telemetry, the signal consists of an electric field which is measured as the potential difference between two electrodes or stakes embedded in the ground. This measured potential difference may also contain various coherent noise components, typically emanating from electrical equipment associated with the drilling rig. Also, waveforms can be assumed to be contained within a relatively narrow bandwidth close to the nominal signal frequency, and filtering is applied to the measured data in order to exclude unwanted frequencies.

If the signal is an electric field Es in direction us and there is a noise component En in direction un, the field measured between points positioned in receiver direction ur is:

$$E_m=(u_s\cdot u_r)\cdot E_s+(u_n\cdot u_r)\cdot E_n$$

In this situation, the receiver electrodes can be positioned in such a manner so to maximize the signal to noise ratio ("SNR"). Provided that us and un are non-parallel, this can be accomplished by positioning the receiver electrodes (also referred to herein as stakes) along a line orthogonal to the noise, so that (un·ur)·En=0 and the SNR is infinite. However, in practical situations this cannot be accomplished, because there are normally multiple noise sources with a variety of orientations.

For example, with two noise sources the following equation applies:

$$E_m=(u_s\cdot u_r)\cdot E_s+(u_{n1}\cdot u_r)\cdot E_{n1}+(u_{n2}\cdot u_r)\cdot E_{n2}$$

If the two noise components are uncorrelated, the problem is equivalent to finding the optimal receiver direction ur such that $$|(u_s\cdot u_r)\cdot E_s|^2/[|(u_{n1}\cdot u_r)\cdot E_{n1}|^2+|(u_{n2}\cdot u_r)\cdot E_{n2}|^2]=\text{maximum}$$

This is not generally a practical approach, as the amplitudes and directions of coherent noise sources, and even the number of such noise sources, may be unknown and variable. In addition, some random noise will be present, uncorrelated between the sources, which gives an additional advantage to maximizing signal strength.

It is therefore useful to provide a way by which the effective receiver direction or can be synthesized and adjusted in real time without physically moving the electrodes. This adjustment can be performed by using a search algorithm to maximize the SNR at any particular time. Also, the SNR can be estimated and displayed by the decoding algorithm.

Synthetic Stake Rotation

For EM telemetry, in most instances, the receiver is a measurement between electrodes close to the earth's surface, which for practical reasons limits the receiver direction ur to the horizontal plane. If two pairs of electrodes are arranged as approximately orthogonal pairs, and the potentials across both pairs are measured, then the electric field can be derived in any horizontal direction. Furthermore, three stakes can achieve the desired electrode layout, if they are arranged in a L pattern.

Assuming that one electrode pair is separated by a distance Dx in direction x, and the other pair is separated by a distance Dy in direction y, then the electric field Ew in direction w may be found by linear superposition:

$$Ew=Vx/Dx\cdot(w\cdot x)+Vy/Dy\cdot(w\cdot y)$$

The optimum direction w is found by passing the synthesized signal Ew to a decoder in which SNR is computed, and using a search algorithm for find the direction w which produces maximum SNR.

Figure 15:
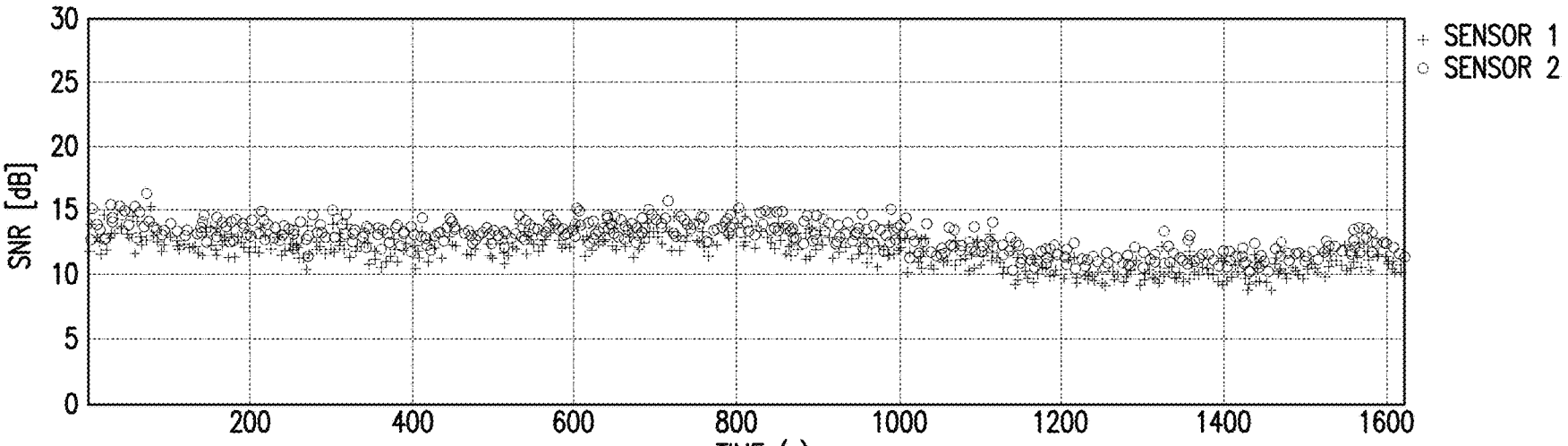
FIG. 15 shows signal to noise ratio ("SNR") computed from each of two orthogonal channels, labeled Sensor 1 (blue) and Sensor 2 (green).
Figure 16:
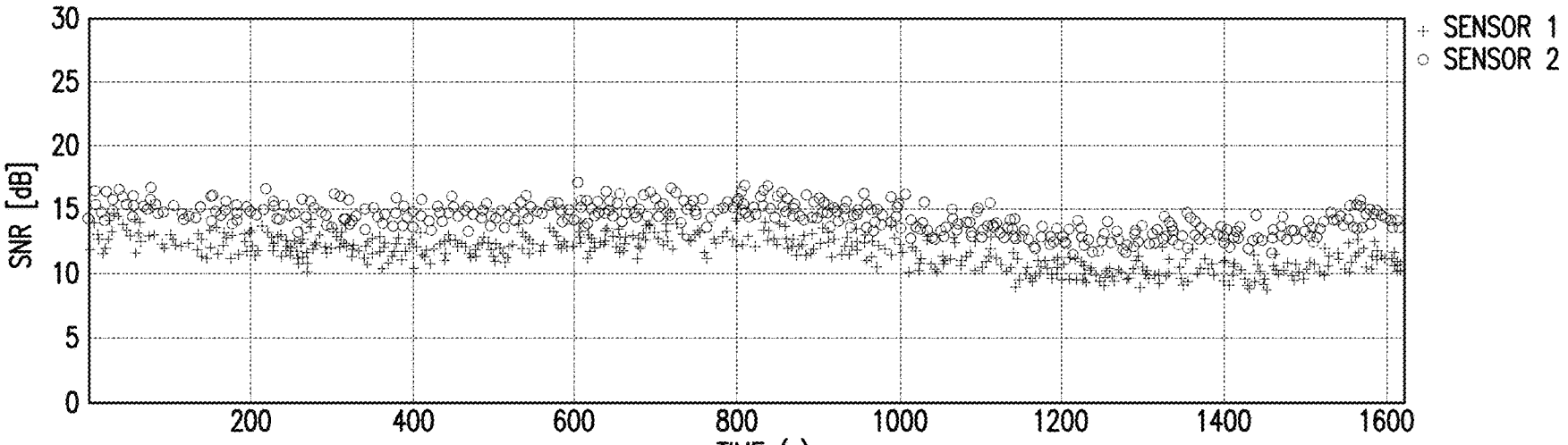
FIG. 16 is similar to FIG. 15 except that Sensor 2 (green) now refers to a synthesized signal, which corresponds to a direction 30 degrees away from the original Sensor 2. A noticeable improvement in SNR is evident.

By applying this technique to real field data, as shown in FIGS. 15 & 16, it has been demonstrated that improvements in SNR are possible. FIG. 15 shows SNR computed from each of two orthogonal channels, labeled Sensor 1 (blue) and Sensor 2 (green). FIG. 16 is similar, except that Sensor 2 (green) now refers to a synthesized signal, which corresponds to a direction 30 degrees away from the original Sensor 2. A noticeable improvement in SNR is evident.

Vertical Magnetometer

Using a vertical magnetometer, the signal and noise components of the received waveform are separated. When receiving a plurality of signals, there is variation in the relationship between signal and coherent noise. However, it is possible to process a combination of channels together and thereby obtain a signal to noise ratio ("SNR") better than that of either individual channel.

A characteristic of an EM telemetry signal is that current is carried along the drill string and casing, and tends to flow radially through the ground to and from the wellhead. The associated magnetic field signal has a strong component circumferentially around the well at the surface, and relatively weak components in other directions. In particular, the vertical component of the magnetic field signal measured at a point on the surface near the wellhead is small. On the other hand, coherent noise normally emanates from electrical machinery associated with the drilling rig. Noise may be radiating from cables or it may be caused by ground loops. Because rig machinery and cables are laid out on the surface of the earth, such electrical noise tends to flow through the earth in a direction close to horizontal. There is therefore an associated magnetic noise component in the vertical direction.

Therefore, a measurement of the vertical component Bz of the magnetic field at a surface location will have a relatively large contribution from coherent noise and a relatively small contribution from EM telemetry signal. In contrast, the electrical EM signal will have a major horizontal component Er in a direction close to radial with respect to the wellhead. Hence, the two signals may be regarded as combinations of signal and noise, such as:

$$Er=a\cdot S+b\cdot N$$

$$Bz'=c\cdot S+d\cdot N$$

where S and N are amplitudes of electrical signal and noise respectively, the prime (') indicates a time derivative, and $a/b\neq c/d$. In this situation the noise can be eliminated by:

$$S=(d\cdot Er-b\cdot Bz)/(a\cdot d-b\cdot c)$$

The time derivative Bz' may be implemented by a time shift of a quarter period for a narrow-band signal, or by a more complex technique such as Hilbert transform over a broader bandwidth. Alternatively, the time derivative may be obtained by numerical finite-difference methods such as taking the difference between adjacent samples.

It will be observed that the calculated signal component S is a weighted sum of Er and Bz'. EM telemetry generally employs encoding schemes in which signal decoding is independent of amplitude, therefore a useful parameter proportional to S can be found with only one variable; the relative weighting factor k:

$$S_{est}=Er+k\cdot Bz'$$

The optimum value for k may be found by providing an initial value, computing Sest in this way, and passing it to a decoder where SNR is computed. A search algorithm may then be used to obtain the value of k which results in maximum SNR.

Example I

Remote Location Test

Figure 17:
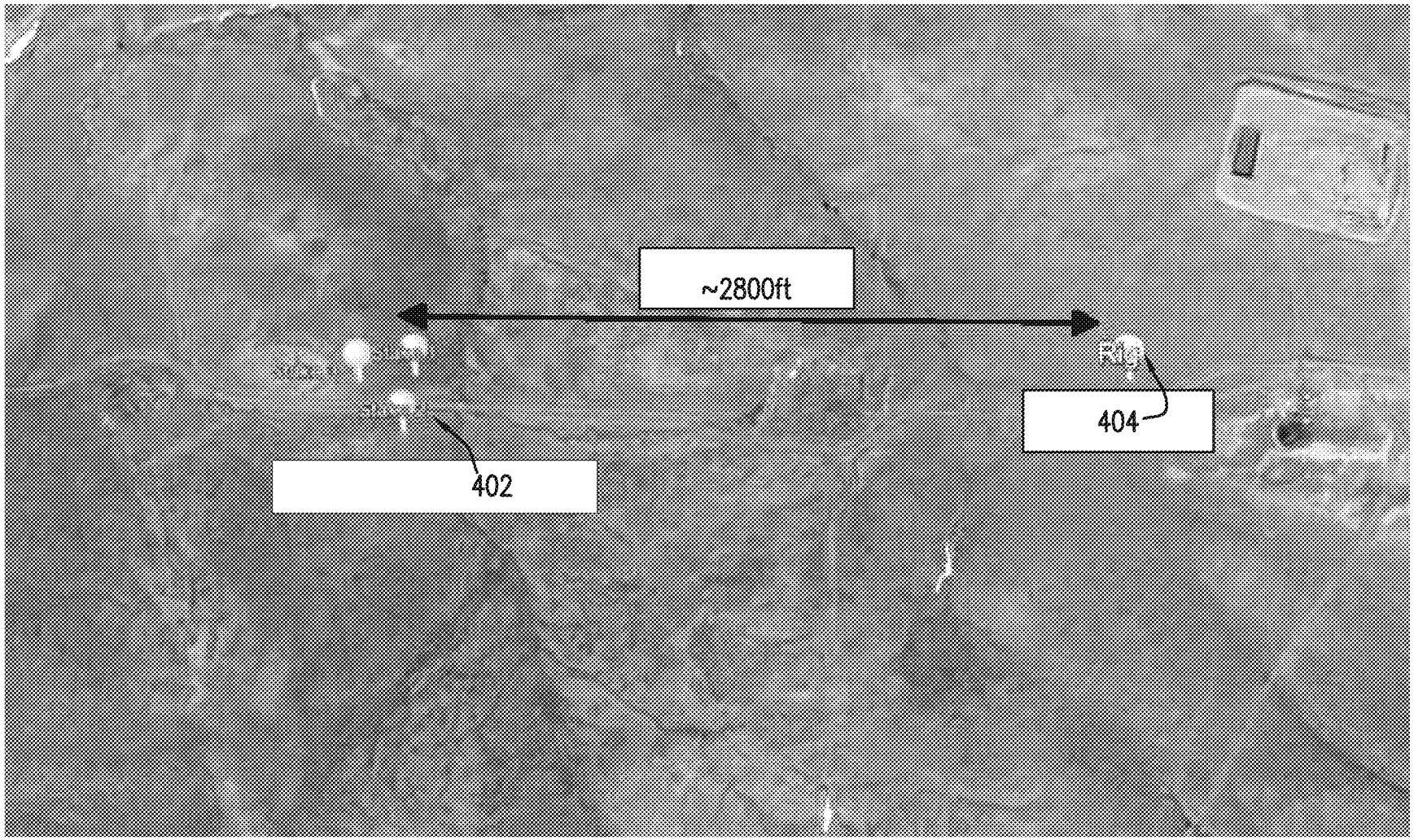
FIG. 17 shows a remote set-up of Example 1 that was placed at approximately 2800 feet away from the well site.
Figure 18A:
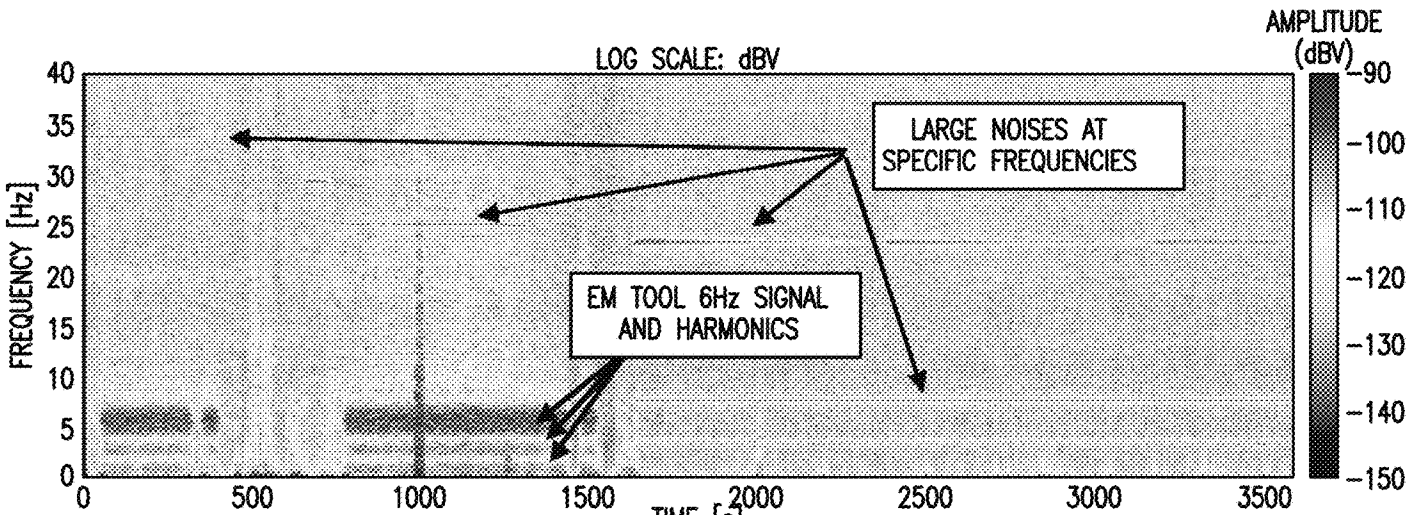
FIG. 18A represents the well site recording at channel 1 of Example I.
Figure 18B:
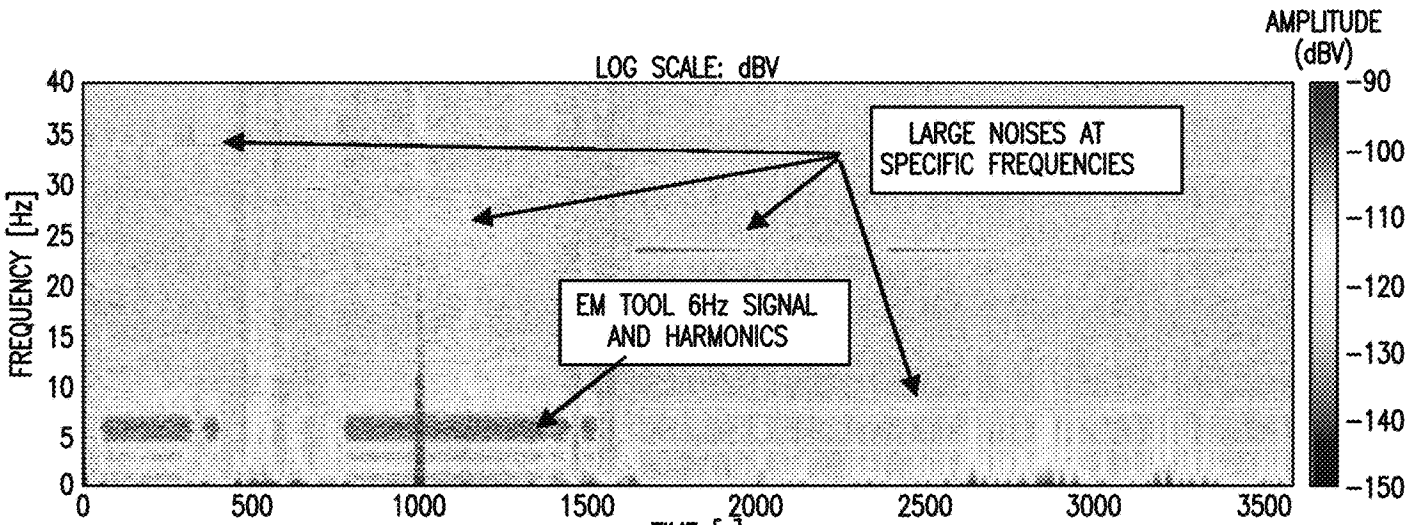
FIG. 18B represents the well site recording at channel 2 of Example I.

As shown in FIG. 17, a remote location 402 was placed at about 2,800 feet away from well site 404. The electromagnetic signal sent by the tool at 7,600 feet deep in the formation was simultaneously recorded at the well site and at the remote location. Two channels were recorded at each location. A first channel (channel 1) was oriented toward the rig and a second channel (channel 2) was deployed orthogonally to the first channel. The tool sent a 6 Hz low-frequency signal into the formation. FIGS. 18A and 18B are spectrograms recorded at the well site. The spectrograms show that high noise levels are measured at well site. The background noise can be estimated to be about −120 dB and large noises were measured at specific frequencies such as 34 Hz, 25 Hz, 8 Hz and 5.6 Hz, for example. The EM telemetry signal was identified at 6 Hz and its corresponding harmonics around it. The signal to noise ratio (SNR) was measured at about 25 dB enabling a good decoding of the 6 Hz telemetry signal. But the noise present at multiple frequencies prevented us from increasing the telemetry frequency. Indeed, large noises recorded in the same frequency band as the EM signal would decrease the SNR and prevented the surface system from decoding without errors.

Figure 19A:
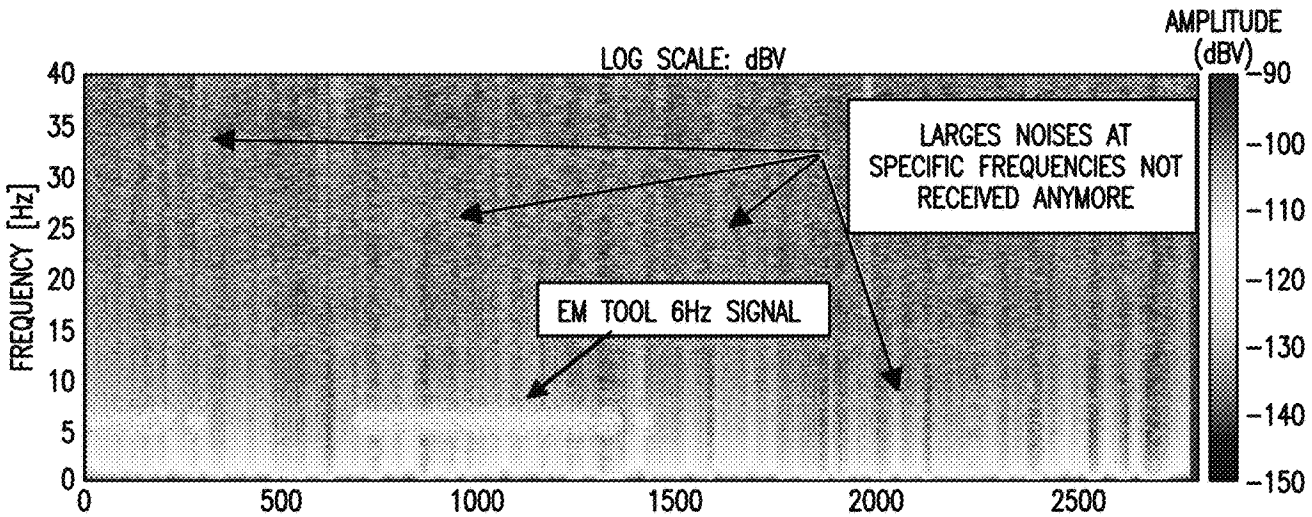
FIG. 19A represents the remote location recording of channel 1 of Example I.
Figure 19B:
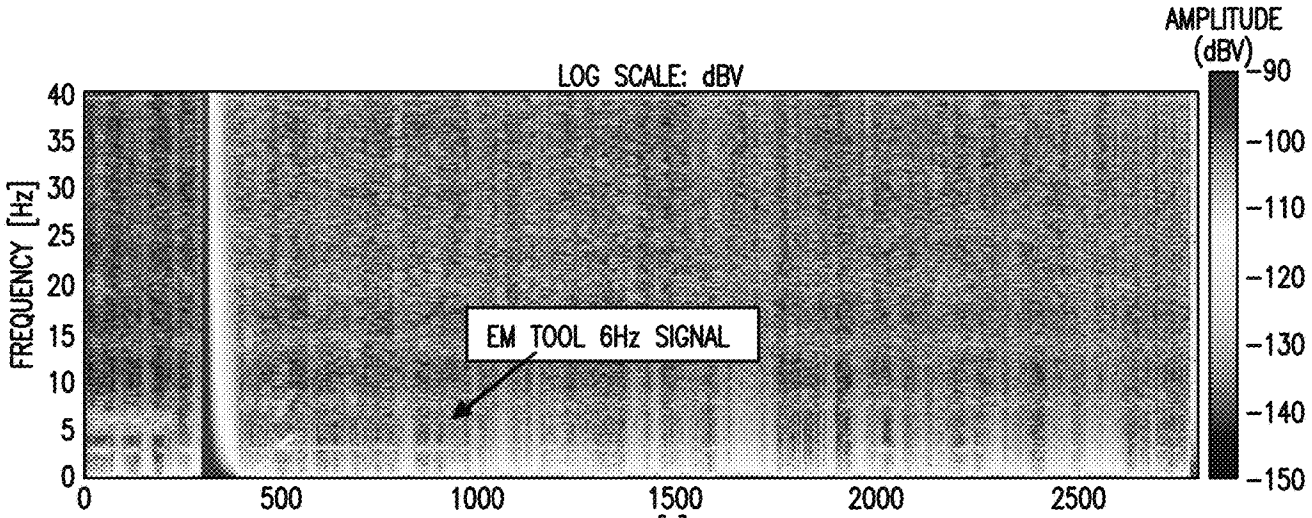
FIG. 19B represents the remote location recording of channel 2 of Example I.

FIGS. 19A and 19B are spectrograms recorded at the remote location and show the background noise at a remote location is lower than that at a well site and estimated at about −140 dB. Noises measured at specific frequencies at well site were not recorded by the remote set-up at the remote location indicating that the right noise has been attenuated. However, the EM telemetry signal was identified at 6 Hz. The amplitude of EM signal was measured at 14 microV on channel 1 and 4 microV on channel 2. The SNR was measured at 17 dB for channel 1 and 13 dB for channel 2. This test showed that EM-telemetry signals can be decoded at remote location and the large noises (noise components) measured at specific frequencies at a well site are not propagated to the remote location. Hence, any frequency can be used to communicate with the EM tool.

Example II

EM-Telemetry Field Test

Figure 20:
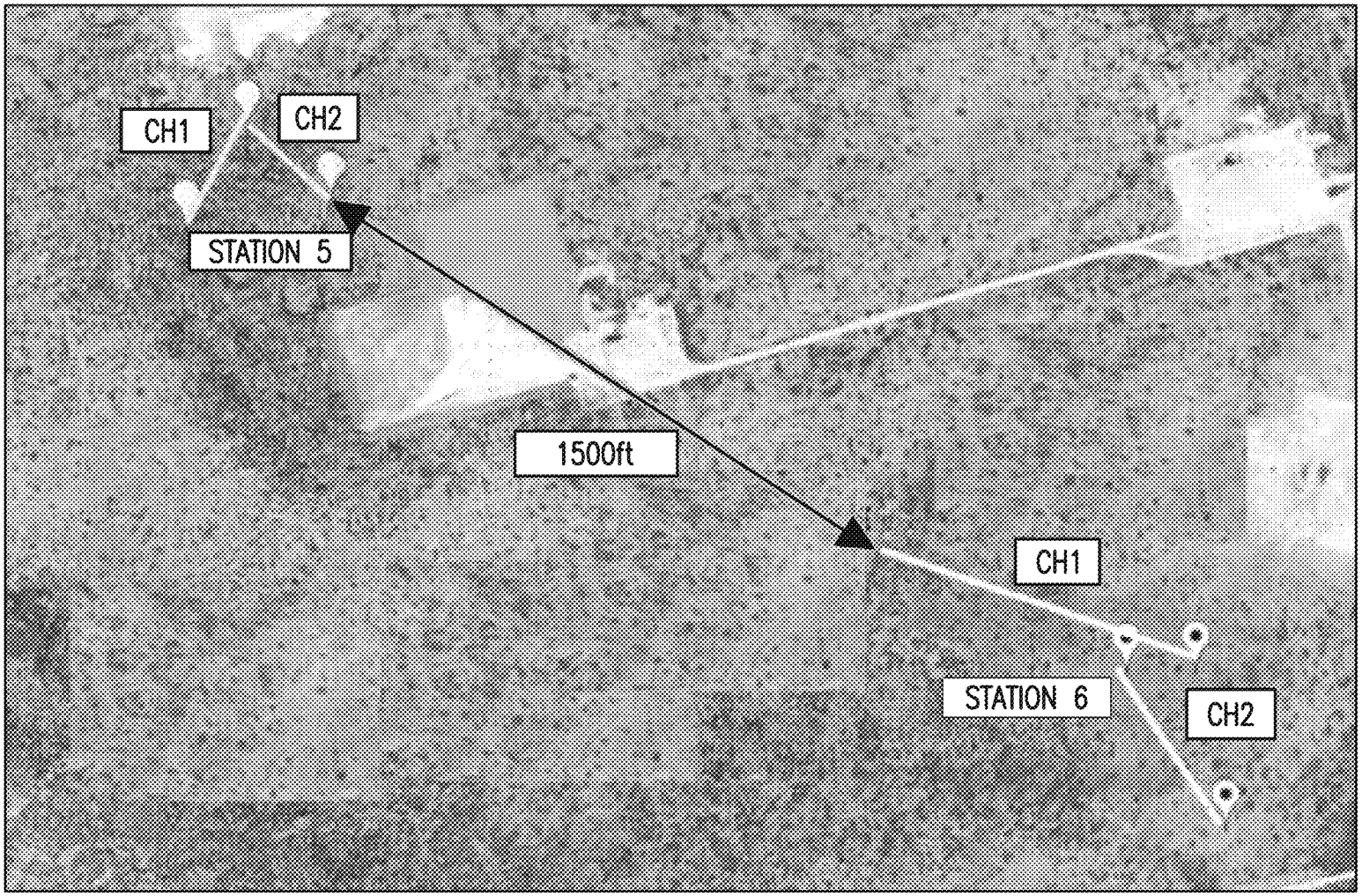
FIG. 20 shows a test site described in Example II where the array of electrodes was deployed in the vicinity of the drilling rig and 1500 feet away from the right.

FIG. 20 shows an array of electrodes deployed in the vicinity of a drilling rig (not shown) and compared with an array of electrodes situated at approximately 1,500 feet away from the drilling well at Station 5. Channel 2 (CH2) on station 6 is deployed at approximately 500 feet away from the drilling rig.

Figure 21A:
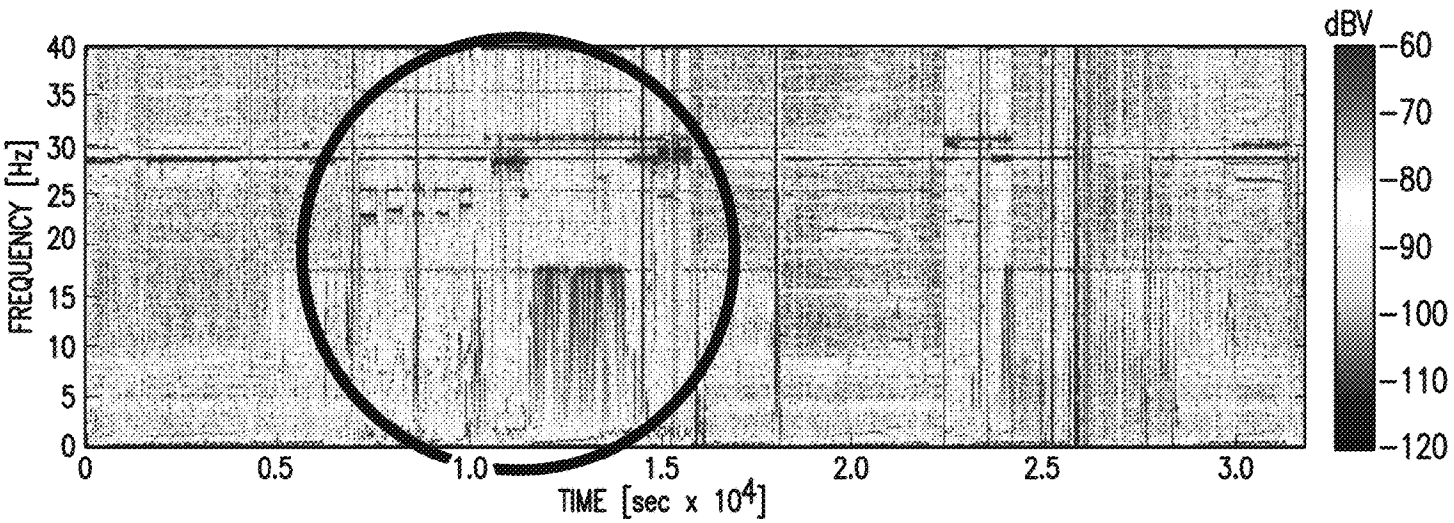
FIG. 21A & FIG. 21B show the spectrograms for station 6 channel 1 (top) and channel 2 (bottom), close to the drilling well described in Example II.
Figure 21B:
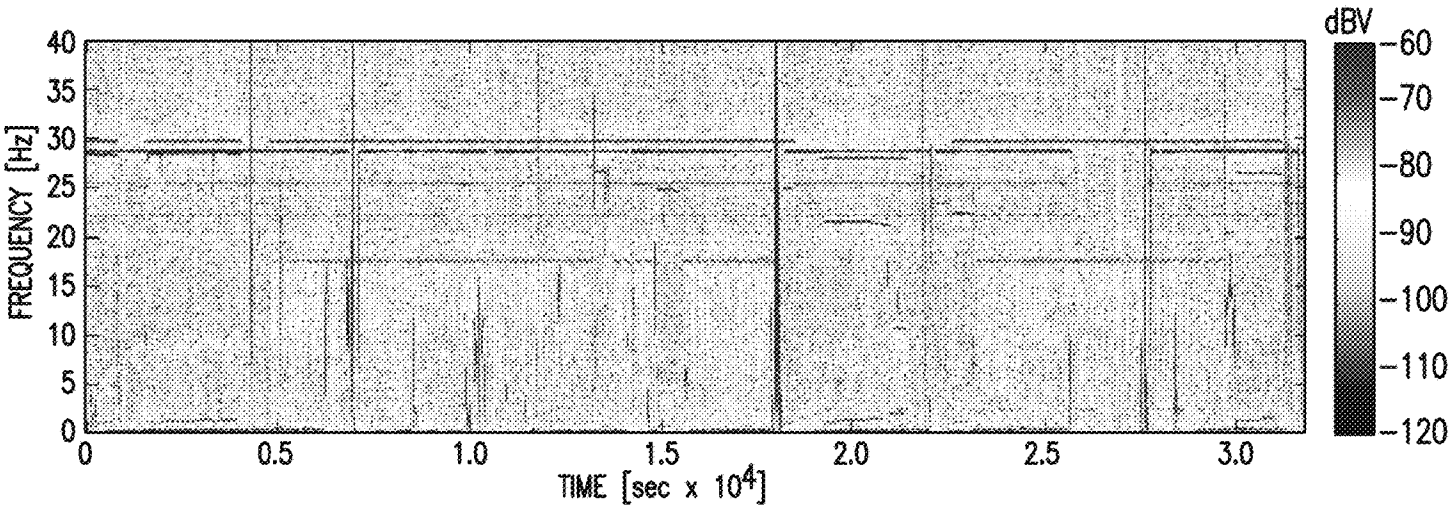
Figure 22A:
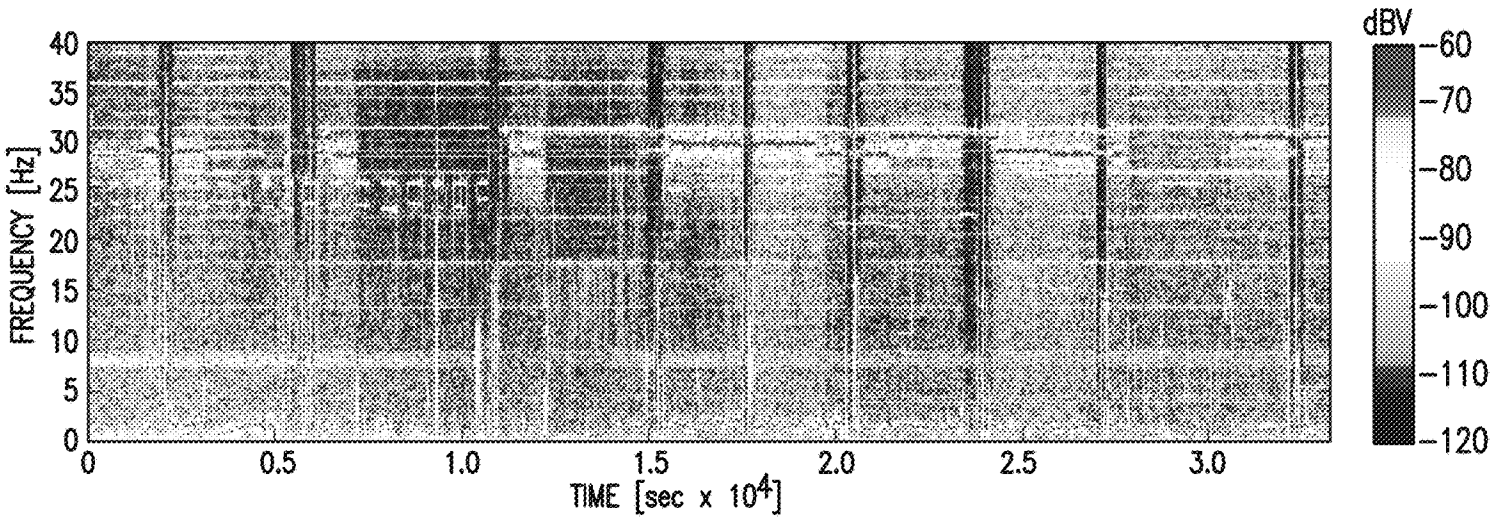
FIGS. 22A & 22B show the spectrograms for station 5 channel 1 (top) and channel 2 (bottom), 1500 feet away from the rig described in Example II.
Figure 22B:
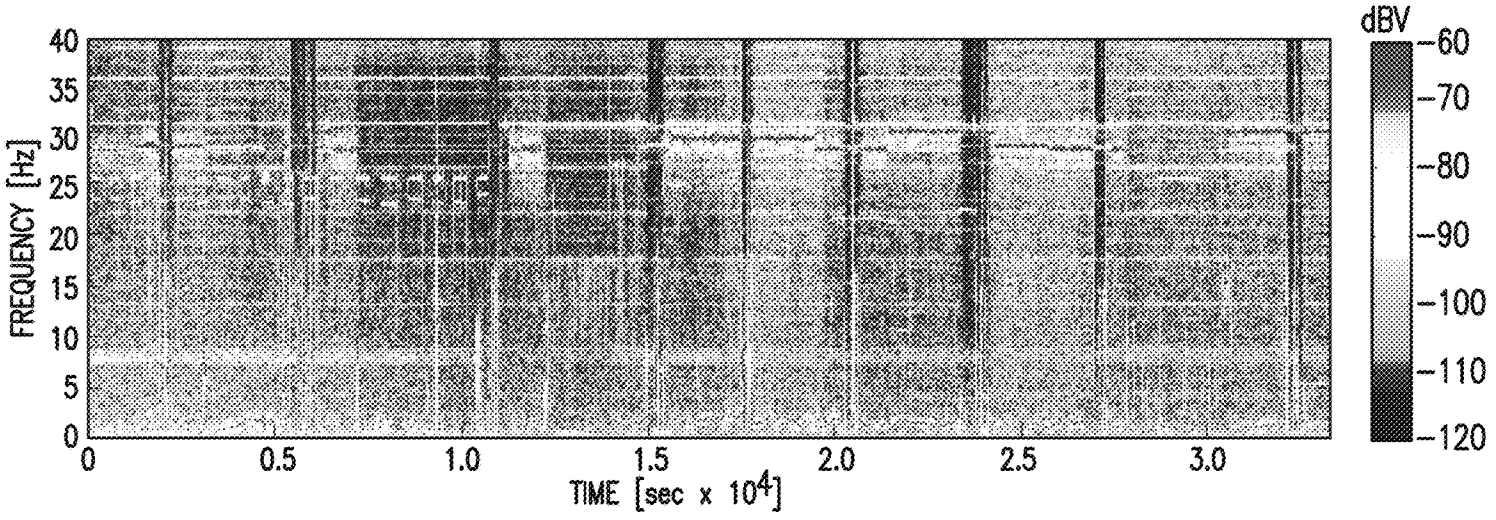

FIGS. 21A and 21 B show spectrograms for station 6 channel 1 (CH1) (top) and channel 2 (CH2) (bottom), close to the drilling well. FIGS. 22A & 22B show spectrograms for station 5 channel 1 (CH1) (top) and channel 2 (CH2) (bottom), 1500 feet away from the rig. In this test, the background noise levels were shown to be much lower on the channels of station 5 (below −100 dB) while the background noise levels at station 6 are approximately −90 dB. SNR measured at station 5 channel 1 were in the order of approximately 15 dB. SNR measured by the conventional channel connected between the well-head and the stakes were smaller than 10 dB. Moreover, during some time intervals, signal was measured by the conventional channel connected to the well-head and was completely buried in noise, preventing reliable EM-communication between the downhole tool and surface (encircled in red, station 6 channel 1).

Additional Uses for Electromagnetic-Telemetry Remote Sensing Wireless System

In addition to enabling EM-telemetry, the EM remote sensing wireless system described herein can also be used as an electrical resistivity tomography array or with an electrical resistivity tomography ("ERT") technique in order to monitor hydrocarbon depletion over long time intervals. Because the pair of electrodes (also referred to herein sometimes as "stakes") are each placed at fixed location separated by a distance, that can be several hundred feet apart, the electrodes are sensitive to small voltage variations. If a known current source injects a current into the ground at known amplitude, then the voltage sensed at each one of the nodes is a function of the resistivity between the electrodes. The measured resistivity is representative not only of the top soil layer but of the formation deep into the ground. For oil fields where Enhanced Oil Recovery ("EOR") is used, typically water is injected, displacing the oil and creating a change in resistivity. Monitoring the resistivity between a number of nodes that are distributed throughout an area that can be up to several square miles, and detecting where resistivity is dropping off over a long time interval provides an indication of hydrocarbon depletion.

Another use of the EM wireless array can be to detect and triangulate the exact location of fracking originated earthquakes. For this purpose, a geophone can be placed into each one of the nodes where the output is digitized, streamed, and synchronized to absolute time by means of a GPS or similar system. The exact distance from the epicenter to each station can then be computed by measuring the arrival time of the P and S waves to each station. Standard seismic triangulation can be employed to determine the location of the origin. The exact epicenter location is useful to understand the long term changes that are taking place in the hydrocarbon bearing formation and to correlate it to production rates or injection strategy. This information also provides the ability to optimize the injection and help understand under what conditions earth quakes are generated in order to reduce its incidence, a matter of general public concern and detrimental to the oil-field industry.

Another application includes prognostic health monitoring of electrical equipment in the area. With numerous pumps in the neighboring area where the EM monitoring stations are deployed, each node can monitor (indirectly) the health status of the pump motors. This is done by analyzing the electrical noise acquired by the nodes. An increase of harmonics or significant changes in the electric noise sensed by the nodes (also referred to sometimes herein as "EM remote nodes") will indicate a possible malfunction or a safety hazard that requires attention. See e.g., Evans, I. C. et al., The Price of Poor Power Quality, AADE-11-NTCE-7, AADE (2011), particularly at pages 15 to 16 incorporated herein by reference.

Additional uses for the systems and methods disclosed herein include borehole to surface EM-telemetry in order to map hydrocarbons. See e.g., Marsala, A. F. et al., First Borehole to Surface Electromagnetic Survey in KSA: Reservoir Mapping and Monitoring at a New Scale, Saudi Aramco Journal of Technology, Winter 2011. Specifically, Marsala et al. teach that "[i]n this pilot field test, the BSEM technology showed the potential to map waterfront movements in an area 4 km from the single well surveyed, evaluate the in sweep efficiency, identify bypassed/lagged oil zones and eventually monitor the fluid displacements if surveys are repeated over time. The data quality of the recorded signals is highly satisfactory. Fluid distribution maps obtained with BSEM surveys are coherent with production data measured at the wells' locations, filling the knowledge gap of the inter-well area. Id. at 36, ¶4 See also, Colombo, D. et al., Sensitivity Analysis of 3D Surface-Borehole CSEM for a Saudi Arabian Carbonate Reservoir, SEG Las Vegas 2012 Annual Meeting; Strack, K. et al., Full Field Array Electromagnetics: Advanced EM from the Surface the Borehole, Exploration to Reservoir Monitoring, 9th Biennial International Conference & Exposition on Petroleum Geophysics, Hyderabad 2012; Zhdanov, M. S., et al., Electromagnetic Monitoring of CO2 Sequestration in Deep Reservoirs, First Break, Vol. 31, 71-78, February 2013 (teaching electromagnetic monitoring of CO2 sequestration in deep reservoirs). Zhdanov et al. teach "geophysical monitoring of carbon dioxide (CO injections in a deep reservoir has become an important component of carbon capture and storage. Until recently, the seismic method was the dominant technique used for reservoir monitoring." Id. at 71, incorporated herein by reference. They present "a feasibility study of permanent electromagnetic (EM) monitoring of CO2 sequestration in deep reservoir" Id.

In short, EM-telemetry, borehole-to-surface technology and cross-well EM technology, each endeavor to bring signal to the surface as efficiently and effectively as possible. As such, each of these technologies can be used in the EM-telemetry remote sensing wireless system and methods described herein.

Furthermore, additional applications for the methods and systems described herein can include: waterfront movement; bypassed/lagged oil zones; fluid displacement; CO2 flooding; and hydraulic fracking monitoring.

We claim:

1. An electromagnetic telemetry remote sensing wireless system, the system comprising:

a downhole tool deployed in a wellbore in a subterranean formation in a drilling area, the downhole tool configured to transmit a modulated electrical current into the formation and thereby generate an electromagnetic signal at Earth's surface; and a surface system configured to receive, at the Earth's surface, the electromagnetic signal generated by the downhole tool, digitize the received signal, and wirelessly stream the digitized signal to an acquisition system at the Earth's surface, wherein each of a plurality of nodes of the surface system includes a distinct pair of first and second spaced apart electrodes, each of the plurality of nodes configured to (i) receive the electromagnetic signal transmitted from the tool as a voltage difference between the first and second spaced apart electrodes, (ii) digitize the voltage differences as digital information, and (iii) wirelessly stream the digital information from the digitized voltage differences to the acquisition system at the Earth's surface.

2. The system of claim 1, comprising a plurality of downhole tools deployed in a plurality of corresponding wellbores drilled in the drilling area, wherein each of the plurality of downhole tools transmits a modulated current into the formation thereby generating corresponding electromagnetic signals.

3. The system of claim 2, wherein each of the plurality of downhole tools operates in a corresponding pad.

4. The system of claim 1, wherein the acquisition system is located at a rig site.

5. The system of claim 1, wherein the acquisition system is configured to demodulate and decode the voltage differences to extract information encoded in the electromagnetic signal.

6. The system of claim 1, comprising at least first, second, and third of said nodes.

7. The system of claim 1, further comprising a noise reduction manager having a de-mixing vector, the de-mixing vector filtering a noise component of the signal and increasing a signal to noise ratio.

8. A surface system for an electromagnetic telemetry remote sensing wireless system, the surface system comprising:

a surface acquisition system configured to receive wireless signals; and a plurality of nodes deployed at Earth's surface in a drilling area remote from noise generating equipment at a rig and remote from a downhole tool transmitting the wireless signals, each of the plurality of nodes including a distinct pair of first and second spaced apart electrodes, each of the plurality of nodes being configured to:

(i) receive the electromagnetic signal transmitted from the downhole tool as a voltage difference between the first and second spaced apart electrodes;

(ii) digitize the voltage difference as digital information; and (iii) wirelessly stream the digital information from the digitized voltage differences to the surface acquisition system.

9. The system of claim 8, wherein the voltage difference includes a plurality of electromagnetic signals transmitted by a corresponding plurality of downhole tools deployed in corresponding wellbores drilled in the drilling area.

10. The system of claim 8, wherein the acquisition system is located at a rig site.

11. The system of claim 8, wherein the acquisition system is configured to demodulate and decode the voltage differences to extract information encoded in the electromagnetic signal.

12. The system of claim 8, comprising at least first, second, and third of said nodes.

13. The system of claim 8, further comprising a noise reduction manager having a de-mixing vector, the de-mixing vector filtering a noise component of the signal and increasing a signal to noise ratio.

14. A method of EM-telemetry remote wireless sensing comprising the steps of:

installing a plurality of nodes in a drilling area at Earth's surface, each of the nodes including a distinct pair of first and second spaced apart electrodes that are remote from noise-generating equipment at a rig site of the drilling area and which digitize voltage differences between the first and second spaced apart electrodes as voltage differences;

transmitting a signal from a downhole tool in a wellbore, the downhole tool being remote from the plurality of nodes;

receiving the signal transmitted from the downhole tool at the plurality of nodes and digitizing the voltage difference between the corresponding first and second electrodes as a digital signal;

wirelessly streaming the digital signal to a data acquisition system deployed in the drilling area; and demodulating and decoding the digitized voltage differences and thereby extracting information encoded in the transmitted signal.

15. The method of claim 14, further comprising deploying the downhole tool in the wellbore, the wellbore drilled in a subterranean formation in the drilling area; and causing the downhole tool to inject a modulated electrical current into the formation to transmit the signal.

16. The method of claim 15, further comprising steering the downhole tool and/or adjusting other drilling process parameters based on the extracted information.

17. The method of claim 15, wherein deploying the downhole tool comprises deploying a plurality of downhole tools in a corresponding plurality of wellbores drilled in the drilling area; and causing the downhole tool to inject comprises causing each of the downhole tools to inject a corresponding modulated electrical current into the formation to transmit corresponding signals.

18. The system of claim 4, wherein the rig site is in the drilling area and the plurality of nodes are in the drilling area and remote from the rig site.

19. The system of claim 18, wherein one or more noise-generating devices are located at the rig site and are remote from the plurality of nodes.

* * * * *